US010237944B2

(12) United States Patent
Hulett et al.

(10) Patent No.: US 10,237,944 B2
(45) **Date of Patent: *Mar. 19, 2019**

(54) SOLID-STATE AUXILIARY LAMP

(71) Applicant: VEKTREX ELECTRONIC SYSTEMS INC., San Diego, CA (US)

(72) Inventors: Jeffery Neil Hulett, Encinitas, CA (US); James Edwards Leland, San Diego, CA (US)

(73) Assignee: Vektrex Electronic Systems Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/979,417

(22) Filed: May 14, 2018

(65) Prior Publication Data

US 2018/0270922 A1 Sep. 20, 2018

Related U.S. Application Data

(63) Continuation of application No. 15/371,667, filed on Dec. 7, 2016, now Pat. No. 9,974,139, which is a continuation of application No. 13/842,392, filed on Mar. 15, 2013, now Pat. No. 9,549,440.

(60) Provisional application No. 61/704,287, filed on Sep. 21, 2012, provisional application No. 61/652,788, filed on May 29, 2012.

(51) Int. Cl.

| | |
|---|---|
| ***H05B 33/08*** | (2006.01) |
| ***H05B 37/02*** | (2006.01) |
| *F21K 9/64* | (2016.01) |
| *F21Y 115/10* | (2016.01) |

(Continued)

(52) U.S. Cl.

CPC ..... *H05B 33/086* (2013.01); *H05B 33/083* (2013.01); *H05B 33/089* (2013.01); *H05B 33/0842* (2013.01); *H05B 33/0863* (2013.01); *H05B 33/0869* (2013.01); *H05B 37/0254* (2013.01); *F21K 9/64* (2016.08);

(Continued)

(58) Field of Classification Search

CPC .... H05B 37/02; H05B 33/08; H05B 33/0842; H05B 33/0863; H05B 33/0869; H05B 31/24

See application file for complete search history.

(56) References Cited

U.S. PATENT DOCUMENTS 7,521,667 B2 * 4/2009 Rains, Jr. ..... F21S 2/00 250/205
8,664,864 B2 * 3/2014 Salsbury ..... H05B 33/0869 315/152

(Continued)

FOREIGN PATENT DOCUMENTS

| | | |
|---|---|---|
| CN | 102194950 | 9/2011 |
| DE | 102010012078 | 9/2011 |
| WO | 2010026509 | 3/2010 |

*Primary Examiner* — Thai Pham

(74) *Attorney, Agent, or Firm* — Sheppard Mullin Richter & Hampton LLP

(57) ABSTRACT

A solid-state auxiliary lamp includes a lamp head having a plurality of LED modules; a thermoelectric cooler coupled to the LED modules; and a drive unit. The drive unit can include a plurality of current sources, each of the current sources coupled to a corresponding LED module; and a processor coupled to the current sources and configured to control each current source to control the light output of each current source's corresponding LED module.

20 Claims, 15 Drawing Sheets

(51) Int. Cl.
*F21V 9/30* (2018.01)
*F21S 2/00* (2016.01)

(52) U.S. Cl.
CPC ..... *F21S 2/005* (2013.01); *F21V 9/30* (2018.02); *F21Y 2115/10* (2016.08)

(56) References Cited

U.S. PATENT DOCUMENTS

| | | | | |
|---|---|---|---|---|
| 2005/0122665 | A1* | 6/2005 | Daniel | A47F 3/001 361/600 |
| 2005/0200311 | A1 | 9/2005 | Youle | |
| 2007/0045524 | A1* | 3/2007 | Rains, Jr. | F21S 2/00 250/228 |
| 2008/0191631 | A1* | 8/2008 | Archenhold | H05B 33/0818 315/158 |
| 2011/0084701 | A1* | 4/2011 | Bancken | H05B 33/0818 324/414 |
| 2011/0254530 | A1 | 10/2011 | Hulett | |

* cited by examiner

SOLID-STATE AUXILIARY LAMP

RELATED APPLICATIONS

This application is a continuation of and claims the benefit of U.S. patent application Ser. No. 15/371,667, which was filed on Dec. 7, 2016 and issued as U.S. Pat. No. 9,974,139 on May 15, 2018; U.S. patent application Ser. No. 13/842,392, which was filed on Mar. 15, 2013 and issued as U.S. Pat. No. 9,549,440 on Jan. 17, 2017; U.S. Provisional Application No. 61/704,287, which was filed on Sep. 21, 2012; and U.S. Provisional Application No. 61/652,788, which was filed on May 29, 2012; all of which are incorporated herein by reference in their entirety.

TECHNICAL FIELD

The disclosed technology relates generally to auxiliary lamps for photometric test systems, and more particularly, some embodiments relate to solid-state auxiliary lamps for photometric testing.

DESCRIPTION OF THE RELATED ART

Industry standard test methods do not accommodate large scale SSL testing. When the integrating sphere and the according method are applied to high power LEDs that are mounted on reliability test boards, large circuit boards with multiple LED samples, the conditions are no longer ideal and thus the testing result is not likely to be accurate. For example, reliability test boards typically hold from ten to eighty LEDs. Consequently, they are physically larger and require many more electrical connections to power the LEDs. If the reliability test board is placed inside the sphere, the wiring and the large circuit board absorb a significant portion of the LED light within the sphere, degrading the optical measurement.

Conventional large-scale LED test systems use designs that degrade the optical measurement. One way to overcome the degraded optical measurement is to make the sphere very large. However, this is very expensive. Moreover, the increased sphere surface area may also degrade the optical measurement as it allows less light to be sent to the detector.

Another method for large-scale LED testing is to place the reliability test board outside a sphere equipped with a small optical port that gathers light from an individual LED. The measure produced is not strictly in accordance with preferred testing methods, but may be good enough for most uses. Nevertheless, this approach has two major drawbacks. First, the measurement has some errors because it is impossible to gather all of the LED light, especially in cases with wide beam patterns. Second, the reliability test board must be mechanically stepped and positioned in x, y, and z coordinates to repeat the measurement for each LED. This stepping requires precision robotic control machinery along with the necessary safety systems to prevent operator injury. In turn, the cost of the system is increased by the complexity. Most importantly, the measurement created by the system is very uncertain. Often times, the system may fail to precisely locate the LED at the sphere aperture; thus, the light gathered may vary from measurement to measurement.

Additionally, temperature control is often overlooked in present systems. High powered LEDs and LED modules generate a significant amount of heat when applied with electrical power. In a packaged product, sophisticated heat transfer structures carry away this heat, ensuring that the LED's semiconductor junction remains below its maximum temperature limit—usually below 175° C. Reliability test boards may not have an equivalent transfer structure to carry away the heat generated by the LEDs mounted thereon. Without the structure, there is a risk that the LED will overheat and fail during the test. The mounting techniques and placement within the sphere make it difficult to create heat transfer structures. As a result, typical automated measurement systems do not use heat transfer structures at all; instead, they rely on short pulsed measurements to limit the heat generated by LEDs. Although that this approach removes the risk of overheating, it overlooks a second thermal issue—that the light output from some LEDs often varies in intensity and color with temperature.

An integrating sphere system is commonly used to measure the luminous flux, or spectral radiant flux, emitted by a light source. Generally, the integrating sphere is a spherical enclosure with a uniform interior reflective coating. The light from the light source is reflected within this sphere to produce a uniform illumination of its inner surface, and a small sample is fed to a detector. This detector may be any array spectrometer. The measurement of a particular light source, or device under test (DUT), involves comparing the sensor readings obtained with the DUT in the sphere to those readings obtained with a reference standard source in the sphere. Particularly, the sensor reading obtained when the DUT is mounted in the sphere and illuminated is compared to the reading obtained when a reference standard source is in the sphere. The flux produced by the DUT is then derived from the ratio of these readings and the known flux produced by the reference standard.

This type of measurement is subject to an effect known as "self-absorption error," in which the responsivity of the sphere system changes due to the substitution of the DUT for the reference standard within the sphere cavity. Such an error will be significant if the physical and optical characteristics of the DUT are significantly different from those of the reference standard. Because the physical size and shape of lighting products, including Solid-State Lighting (SSL) products, can be very different from that of the reference standard, the self-absorption effect can be significant, and correction for this effect can be critical to achieving reliable results.

Prior solutions to this problem use an auxiliary lamp in the integrating sphere, which remains in the sphere when the DUT is substituted for the reference standard. This auxiliary lamp is used as a control element to characterize any change in the responsivity of the sphere system due to the substitution.

The self-absorption effect is measured by comparing the sensor reading obtained for the auxiliary lamp when the reference standard is mounted in the sphere to that obtained when the standard is replaced by the DUT. A self-absorption factor is calculated as the ratio of these readings, and applied as a correction factor to the original measurement results.

To be suitable for its purpose, an auxiliary lamp ideally meets at least most of the following requirements: (1) Stability—the lamp desirably provides a repeatable output throughout the process of self-absorption measurements; (2) Spectral range—for spectroradiometric applications, the auxiliary lamp desirably emits broadband radiation over the entire spectral range of the spectroradiometer. At all wavelengths in this range, the optical signal level is preferably sufficient to provide acceptable signal-to-noise performance; (3) Spectral distribution—For photometric applications, it is desirable that the auxiliary lamp have a spectral distribution similar to that of the DUT, especially if the absorption characteristics of the DUT are strongly spectrally dependent;

and (4) Geometric distribution—is desirable that the geometric distribution of flux from the auxiliary lamp within the sphere should be similar to that of flux from the reference standard and/or the DUT. The auxiliary lamp should be shielded so that it does not directly illuminate any part of the DUT or the sensor port.

Conventional auxiliary lamps can suffer from a number of drawbacks. First, a conventional incandescent auxiliary lamp requires significant time (10-30 minutes) to reach a steady-state, i.e., to become sufficiently stable to be suitable for use in self-absorption measurement. In contrast, the optical measurements required for the self-absorption correction procedure involve integration times on the order of tens of milliseconds. Therefore, most of the time required to perform the self-absorption correction procedure, and most of the useful life of the lamp, is consumed by warm-up time.

Second, because the output of an incandescent lamp changes over time, and due to variations in ambient temperature, both readings used in the self-absorption procedure must be performed within a relatively short period of time, and under similar environmental conditions. In practice, this generally means that for each new type of DUT, the entire self-absorption characterization procedure must be performed, including the physical installation of the reference standard in the sphere—even when a new sphere calibration is not required.

Incandescent lamps generate a significant amount of heat, which can be problematic, especially in a small sphere. The output of the reference standard, and of the DUT, is typically temperature-dependent; therefore, heating of the sphere by the auxiliary lamp can increase measurement uncertainty, and/or complicate the measurement process.

Incandescent lamps exhibit much lower spectral flux at the short-wavelength end of the visible spectrum than at longer wavelengths. A typical incandescent lamp exhibits approximately 5 times less power in the blue region than in the red, and approximately 25 times less flux at the violet end of the spectrum than at the red end. Because the silicon sensors typically used in both spectroradiometers and photometers are significantly less sensitive at shorter visible wavelengths, this means that the signal-to-noise ratio for violet or blue light may be one to two orders of magnitude lower than for red light.

Filters may be used to modify the spectrum of incandescent lamps, but the range of spectral shapes achievable is limited, and for many target spectra, the associated loss of optical signal would be prohibitive. Also, the general trend in the lighting industry is to move away from incandescent lamps and toward more energy efficient technology. In the foreseeable future, it may become more difficult or impossible to obtain incandescent lamps suitable for use as auxiliary lamps.

BRIEF SUMMARY OF EMBODIMENTS

A solid-state auxiliary lamp (SSAL) comprises a lamp head comprising: a plurality of LED modules; a thermoelectric cooler coupled to the LED modules. The auxiliary lamp further comprises a drive unit comprising: a plurality of current sources, each of the current sources coupled to a corresponding LED module; a processor coupled to the current sources and configured to control each current source to control the light output of each current source's corresponding LED module.

Other features and aspects of the disclosed technology will become apparent from the following detailed description, taken in conjunction with the accompanying drawings, which illustrate, by way of example, the features in accordance with embodiments of the disclosed technology. The summary is not intended to limit the scope of any inventions described herein, which are defined solely by the claims attached hereto.

BRIEF DESCRIPTION OF THE DRAWINGS

The technology disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

The figures are not intended to be exhaustive or to limit the invention to the precise form disclosed. It should be understood that the invention can be practiced with modification and alteration, and that the disclosed technology be limited only by the claims and the equivalents thereof.

DETAILED DESCRIPTION OF THE EMBODIMENTS

The technology disclosed herein is directed toward a system and method for providing a solid-state auxiliary lamp, which may, in some embodiments reduce or overcome one or more of these shortcomings. In one embodiment, a Solid-State Auxiliary Lamp (SSAL) utilizes LEDs of one or more colors (i.e. spectral flux distributions) to provide the auxiliary lighting and is powered by a multichannel current source. In another embodiment, the SSAL utilizes LEDs of one or more colors (i.e. spectral flux distributions) to provide the auxiliary lighting and is powered by a time division multiplexed source.

Figure 1:
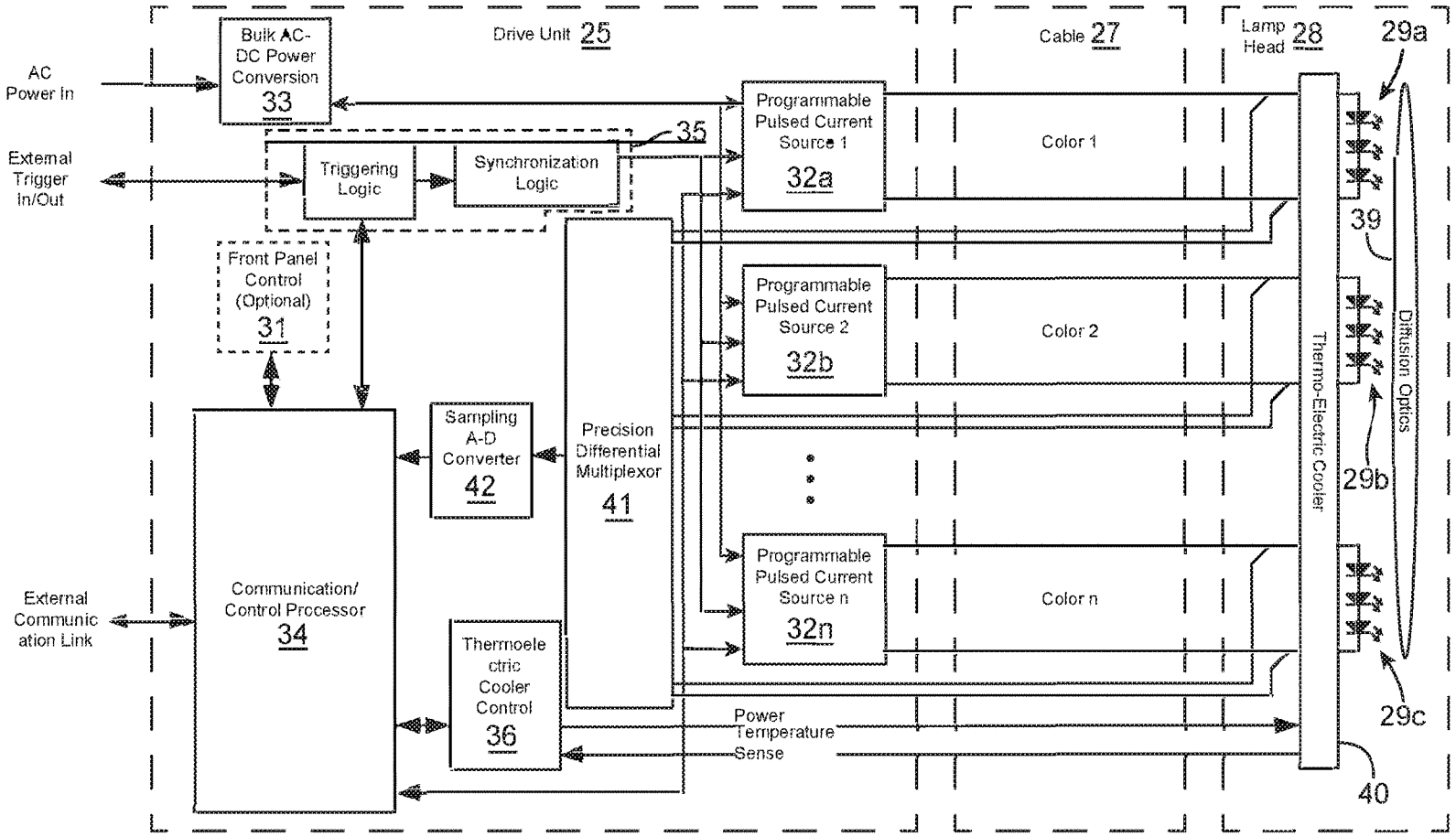
FIG. 1 is a block diagram of an example SSAL in accordance with one embodiment of the technology described herein.

FIG. 1 is a block diagram of an example SSAL in accordance with one embodiment of the technology described herein. Referring now to FIG. 1, the example SSAL includes a drive unit 25, a cable or cable assembly 27 and a lamp head 28. Drive unit 25 provides power for the lamp head 28. Particularly, in some embodiments, drive unit 25 provides precise current pulses to drive one or more banks of LEDs 29*a*-29*n* in the lamp head. It also serves as the control and communication link to the user—either through a front panel user interface or control 31, or an external computer.

The drive unit 25 powers the lamp head 28 with multiple pulsed current sources 32*a*, 32*b*, 32*n* that provide separate differential drive current for each colored LED bank 29*a*, 29*b*, 29*n*. Current sources 32*a*, 32*b*, 32*n* receive DC power from AC-DC power converter 33, which can be connected to an external AC power source. Current sources 32*a*, 32*b*, 32*n* provide pulsed power to their respective LED bank 29*a*, 29*b*, 29*n*, under the control of communication/control processor 34. Triggering and synchronization logic 35 can be included to control when the light is produced and from which bank. This logic 35 may be used to synchronize a spectroradiometer, for example. Cable 27 conveys the signals between the current sources 32 and the lamp head 28.

Drive unit 25 also includes a thermoelectric control function to regulate the temperature of the LEDs 29. LEDs 29 are highly temperature sensitive—their output luminous flux can change a few tenths of a percent with a one degree temperature shift. Accordingly, temperature sensors (not shown) provide temperature information to thermoelectric cooler control 36, which is under the control of processor 34. Based on temperature information, thermoelectric cooler control 36 can control the amount of cooling provided by a thermoelectric cooler 40 to help maintain a desired temperature. To validate the operating point of the LEDs 29 is correct, the unit also includes voltage sensing circuitry to sample and measure the forward voltage of each bank during the current pulse.

A differential multiplexer 41 can be included and can sample parameters that can be used by processor 34 to confirm operation within proper bounds. Sampled parameters can include voltage applied to the LED banks 29*a*, 29*b*, 29*n*, current, and temperature. An A/D converter 42 can be provided to digitize the sampled, multiplexed parameters for processor 34. A-D converter 42 can be separate or it can be internal to processor 34.

Lamp head 28 is configured to mount on the sphere and preferably provide controlled illumination for the entire sphere. Lamp head 28 attaches to the integrating sphere, usually through a port in the wall of the sphere. The body of the lamp head 28 can exist outside the sphere and a portion of the lamp head extends into the sphere, providing illumination in a $2\pi$ or $4\pi$ pattern inside the sphere. The precise pattern is dependent upon the LED radiation pattern, and the way the LEDs 29 are mounted. Diffuser optics 39 can also be provided in front of the LEDs 29 to adjust or influence the pattern. The LEDs 29 within the head are mounted to thermoelectric cooler 40. Thermoelectric cooler 40 keeps the LEDs 29 at a predefined temperature during operation so that the light output can be maintained more consistently and with greater repeatability.

LED banks 29*a*, 29*b*, 29*n* on lamp head 28 can be configured to provide a different color output. For example, each bank may provide a different color output and controlling the illumination provided by each bank can control the overall spectral output of the lamp head 28.

Figure 6:
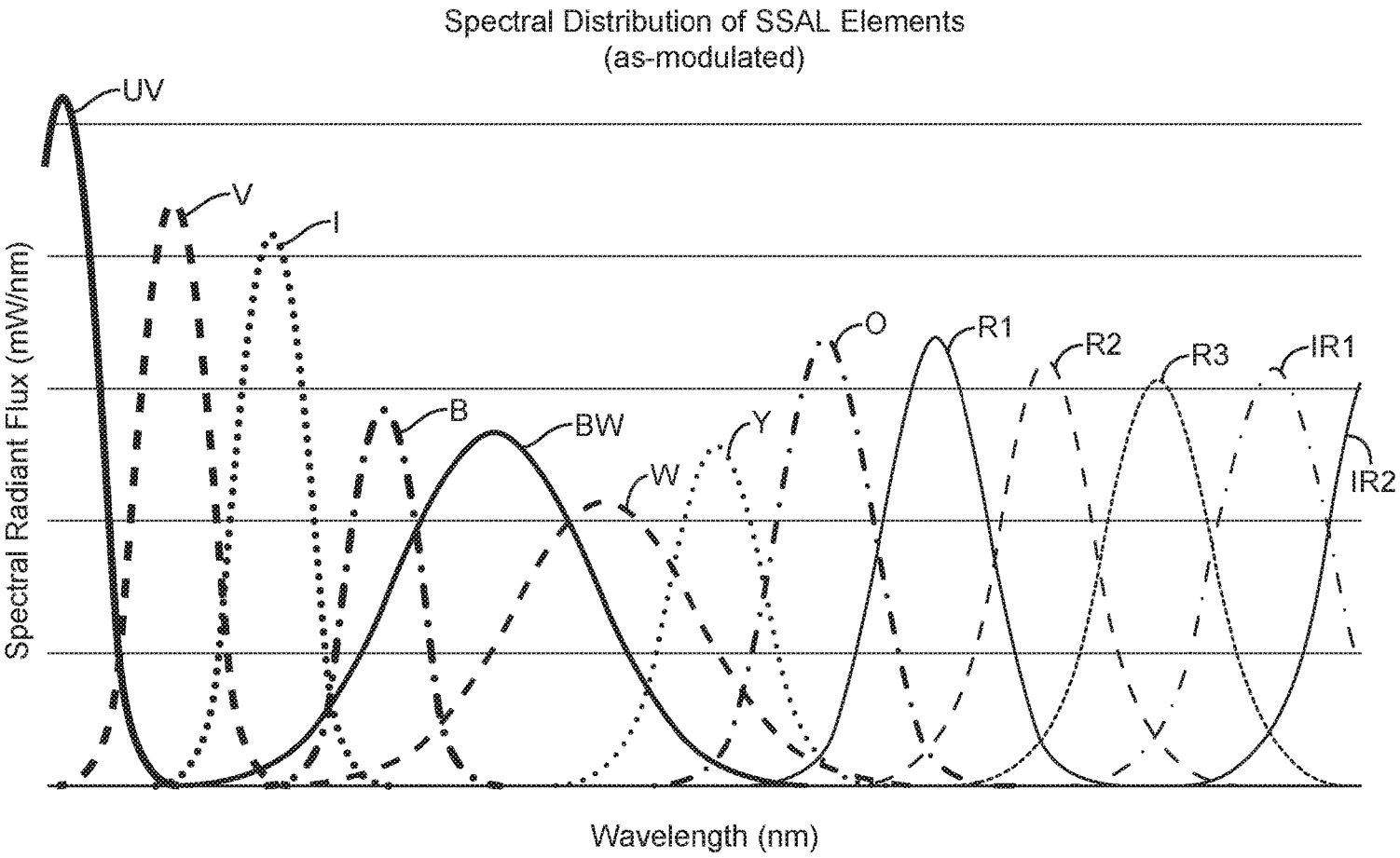
FIG. 6 illustrates a spectral distribution for each element of an exemplary SSAL model designed to cover the full visible range.
Figure 7:
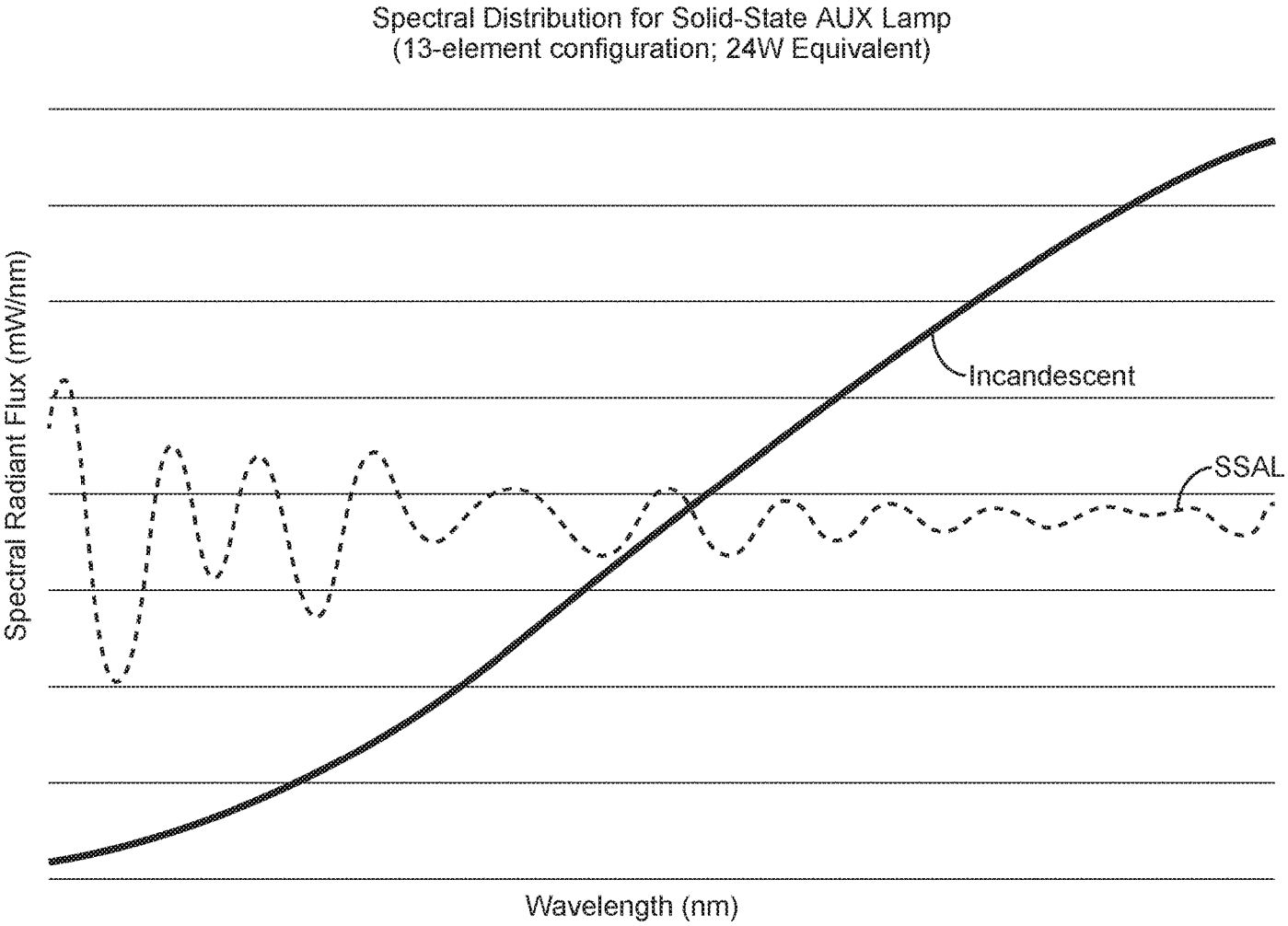
FIG. 7 illustrates that such an SSAL could be modulated to approximate an equal-energy spectrum, with more energy than comparable incandescent lamp at short wavelengths, and less at long wavelengths.
Figure 8:
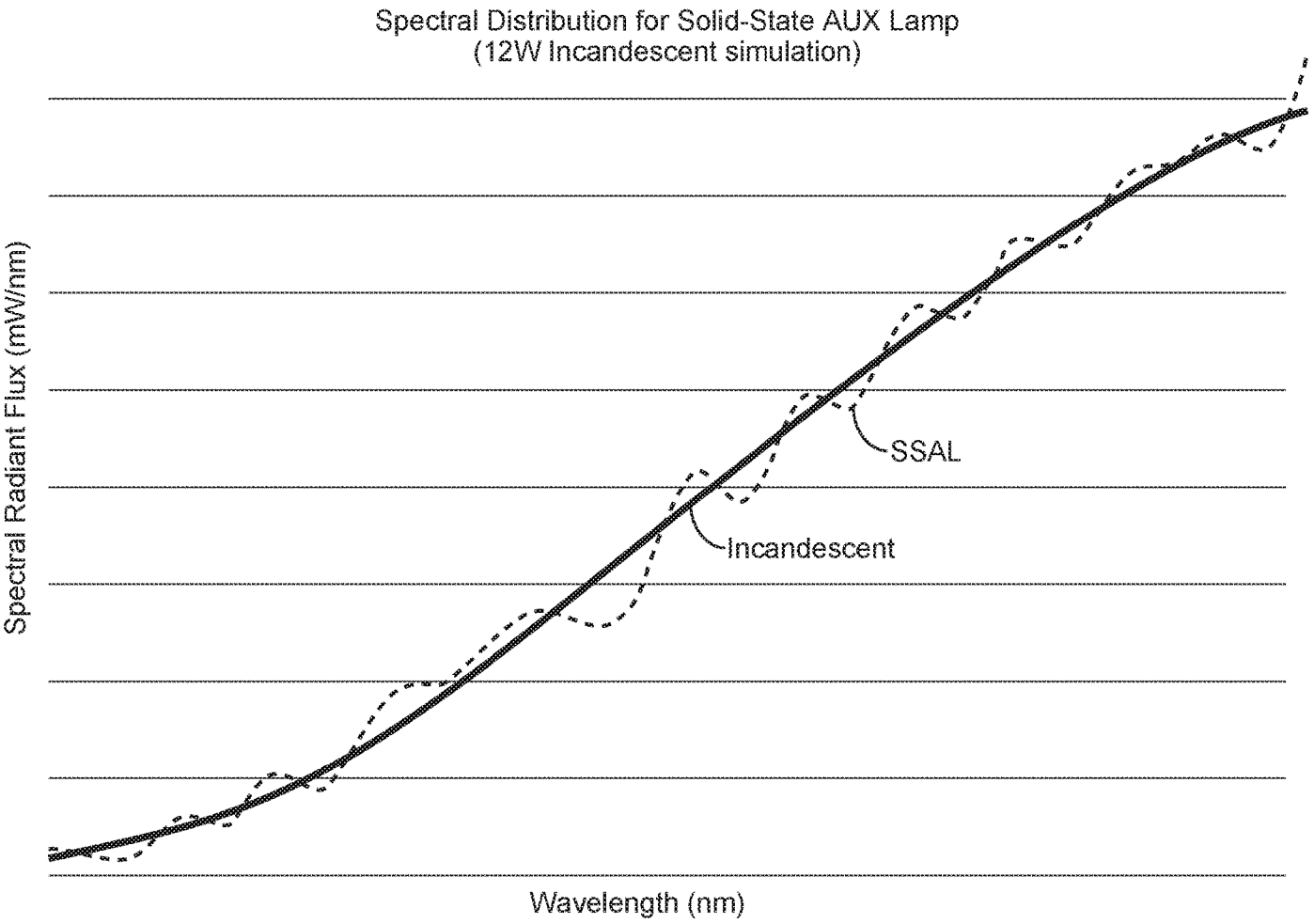
FIG. 8 illustrates the same 13 element SSAL, with elements modulated differently, in order to approximate an incandescent spectrum.

In operation, the desired output spectrum of the lamp head 28 is obtained by combining the output of several elements, or types of LEDs, (e.g., banks 29*a*, 29*b*, 29*n*) with different colors (i.e. spectral flux distributions). Examples of this are illustrated in FIGS. 6-8, which are described in more detail below. By modulating the relative output of each color (e.g., each bank), the overall output spectrum may be tuned in shape and amplitude. In the preferred embodiment, the SSAL is designed to produce light with a negligible warm-up period. To do this may use short, individual light pulses rather than steady state output.

In various embodiments, the SSAL may be operated in at least four different modes. In two of these modes (continuous and regular pulse), the SSAL produces an output which is approximately constant on the time-scale of photometric or spectroradiometric measurement. In the other two modes (single pulse and single burst), the SSAL produces short individual pulses or bursts of pulses, which can be synchronized with instrumental measurements. In practice, one embodiment employs the single pulse mode.

In the continuous mode, each element of the SSAL is driven at a constant set current. In the regular pulse mode, each element of the SSAL is driven by a regular series of pulses, with a period much smaller than the time constant of the measurement instrumentation. The result is measured as a constant output. In the single pulse mode, each element of the SSAL is driven by a short individual pulse at a constant set current. In the single burst mode, each element of the SSAL is driven by a short burst of regular pulses. The duration of the burst is smaller than the integration time of the sensor, and the pulse train has a period much smaller than the sensor's time constant.

Different types of modulation may be used to control the output. In some embodiments, the output of each SSAL element may be controlled with current modulation, pulse width modulation, or some combination thereof. With current modulation the output of each element of the SSAL is modulated by adjusting the set current at which it is driven. With pulse-width modulation (PWM) the output of each element of the SSAL is modulated by adjusting the width of the pulse, while the set current remains constant. Pulse width modulation can generally allow for output adjustment without undesirable color shift.

Figure 2:
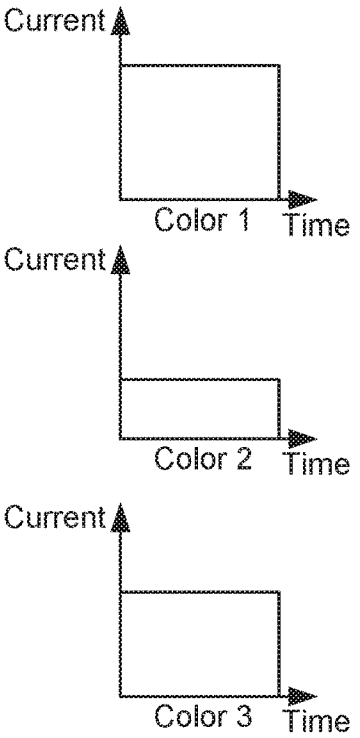
FIG. 2 illustrates concurrent pulse operation of an SSAL.
Figure 3:
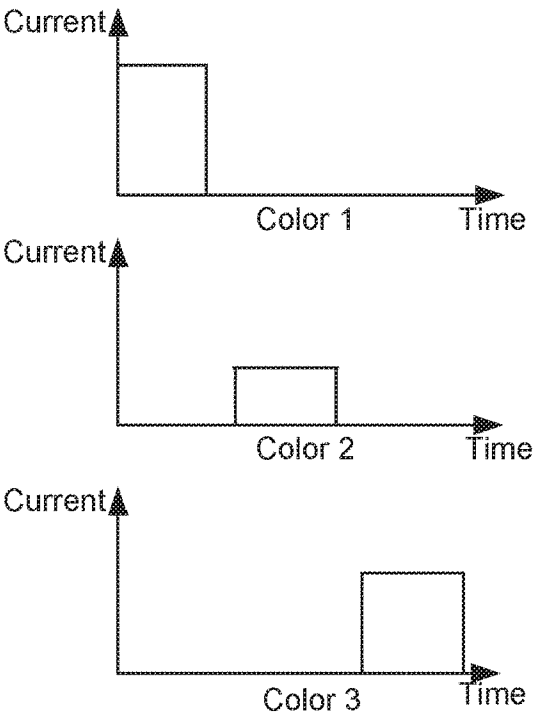
FIG. 3 illustrates sequential pulse operation of an SSAL.
Figure 4:
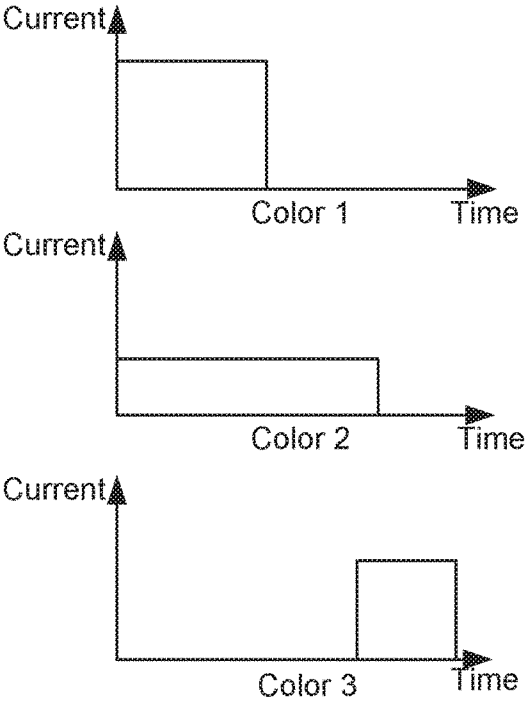
FIG. 4 illustrates a hybrid pulse operation of an SSAL.

The SSAL elements may all be pulsed concurrently, as illustrated in FIG. 2; this produces an output spectrum that is constant temporally. Alternatively, the SSAL elements may be pulsed sequentially, as illustrated in FIG. 3. In this case the output spectrum changes during the light pulse. The spectroradiometer integrates this changing spectrum into the desired composite spectrum. The SSAL elements may also be pulsed semi-sequentially. This hybrid approach is illustrated in FIG. 4. The sequential or semi-sequential approach is compatible with the application of Time-Division Multiplexing (TDM), as described below with reference to FIG. 5.

The application of drive current to an LED raises its internal junction temperature. If the drive current applied is constant, this internal temperature rises until thermal equilibrium is reached, with the LED junction temperature maintained at some constant value above ambient temperature. LEDs are highly temperature sensitive; both total flux output and chromaticity (color) can change significantly with small changes in junction temperature.

In continuous and regular pulse modes, the magnitude of such thermal effects on optical output are roughly equivalent, depending upon the time-average current applied to the LED. The output of each LED will gradually drift until thermal equilibrium is reached. To obtain a repeatable measurement in these modes, it may be necessary to wait until the all LEDs have reached thermal equilibrium, which may require several minutes or more.

In Single Pulse and Single Burst modes, it is possible to obtain repeatable measurements with negligible warm-up time. In these modes, measurements are synchronized with an individual pulse or burst, and pulses or bursts are short (generally on the order of 10-100 milliseconds), so that self-heating, and associated changes in optical output, are limited. After each pulse, the LEDs 29 are brought back to their nominal temperatures by the TEC 40 before another light pulse is produced.

Figure 5:
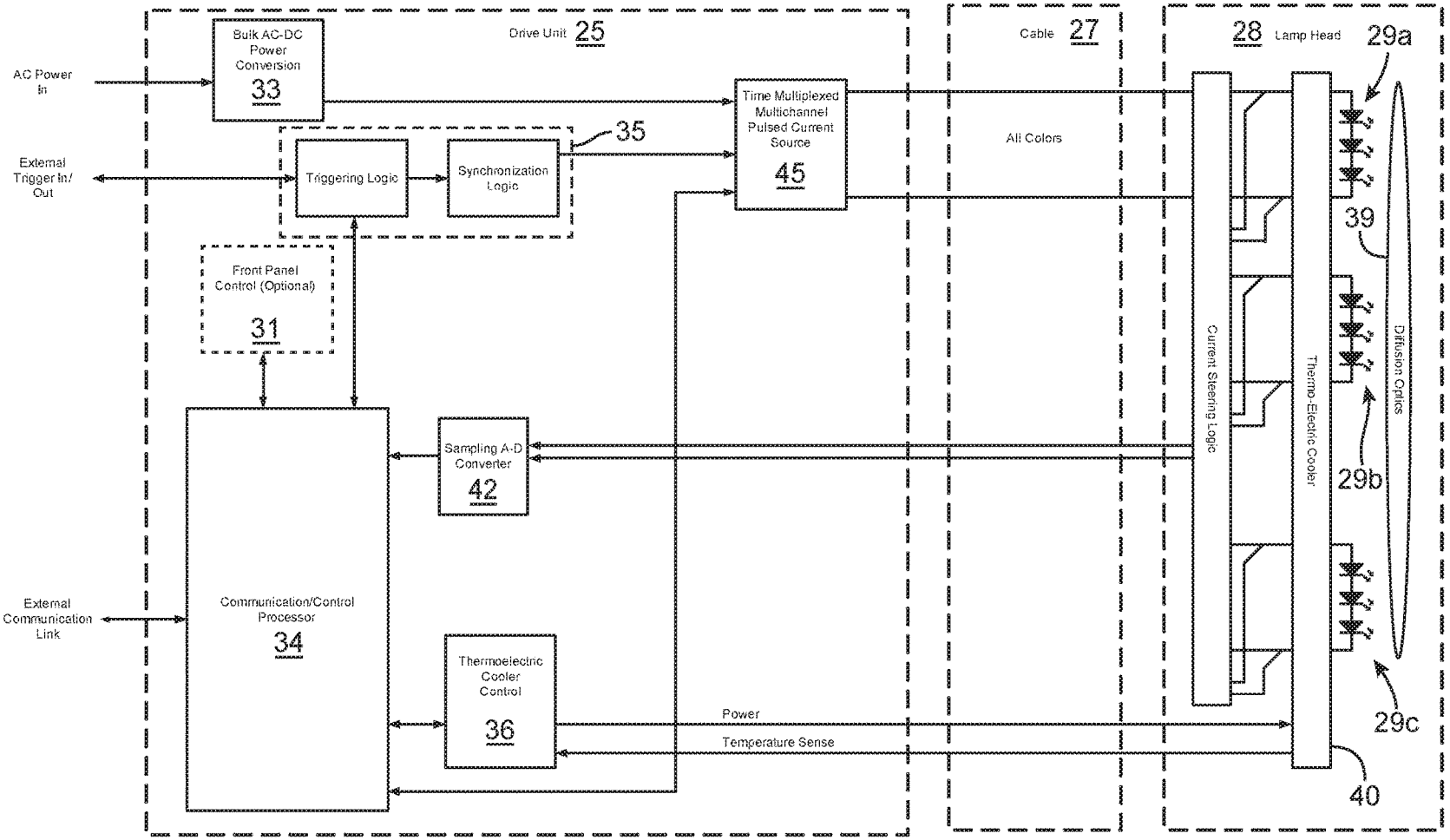
FIG. 5 illustrates an SSAL using a single channel drive unit.

In another embodiment, a single channel drive unit can be provided. An example of a single channel embodiment is shown in FIG. 5. As discussed above, both the semi-sequential and sequential pulse methods have the advantage that peak heating power is reduced. In the sequential approach only a single LED channel is active at one time. A time-multiplexed, multi-channel, pulsed current source 45 can be used in conjunction with current sensing logic 46 to drive the LED banks 29*a*, 29*b*, 29*n*. This current source 45 can be configured to provide drive current pulses for each bank 29*a*, 29*b*, 29*n* in a different time division. The pulses are sent as TDM signals to current steering logic 46. Current steering logic 46 demultiplexer the TDM signals, and directs the current pulses to their respective LED banks 29*a*, 29*b*, 29*n*. As one example, these embodiments may be implemented using the LED sequencing technology described in U.S. patent application Ser. No. 12/840,454, Publication No. 2011/0025215, filed Jul. 21, 2010, which is hereby incorporated in its entirety. With this approach, the SSAL may be realized with a drive unit containing only single current source channel. This approach reduces the hardware used over the embodiment shown in FIG. 1, reducing the cost and size of the SSAL.

As noted, in this embodiment the current drive for each color or bank 29*a*, 29*b*, 29*n* is time-multiplexed. The current drive waveform includes a low level component that powers and controls current steering logic 46 that is located in the lamp head. The steering logic 46 activates each color in turn to produce the sequential pulsed light output. This embodiment reduces the wire count in the cable dramatically. Only two wires are needed for the current signal. Additional wires may be used for the TEC control signal and the voltage sampling, or these signals can be time multiplexed onto the pair of current drive signals. In this case the SSAL can be realized with a two wire drive cable. This implementation would be useful in replacement situations where existing incandescent bulbs are supplied with only two wires.

In some embodiments, a range of different types of LEDs, with differing spectral characteristics, are included in the lamp head 28 in order to produce a combined light output that meets desired general criteria. These criteria can include spectral range, flux output, spectral distribution, and stability. The selection of LEDs to meet these criteria may be subject to certain constraints, including available peak wavelengths and spectral distributions, available LED technologies, and available power levels.

For spectroradiometric applications, the SSAL should preferably produce significant radiation over the entire spectral range of the spectroradiometer. According to industry standards, the spectroradiometer must cover the visible spectral range (360 to 830 nm preferred; 380 to 780 nm at minimum). Also, the luminous flux or spectral radiant flux output of the SSAL is ideally sufficient to provide acceptable S:N performance for the given application. Specific criteria for acceptable performance are discussed below.

The fundamental requirements for the spectral distribution of the SSAL are related to the combined requirements of spectral range and flux output. The criteria for optimal spectral distribution depend upon the specific application, as described below.

The LEDs used to construct the SSAL, as-installed, are preferably sufficiently stable that any uncertainty in self-absorption measurement due to temporal variation in SSAL output is much smaller than the uncertainty due to uncorrected self-absorption. For this reason, LEDs used in the SSAL are selected for stability, and individual LEDs are aged or "burned-in" as needed prior to use to further stabilize them. The TEC can also play a role in maintaining output stability.

In some embodiments, there may be constraints on LED selection. One constraint is available peak wavelengths. LEDs are available with peak wavelengths located throughout most of the visible spectral range, including wavelengths near the limits of the visible spectral range. LEDs with peak wavelengths in certain regions of the visible spectrum, however, may be unavailable or unsuitable for use in an SSAL. For example, the availability of suitable LEDs with peak wavelengths in the 530-590 nm and 660-800 nm regions is presently limited. In order to provide spectral flux in these "holes" in the visible spectrum, LED packages that incorporate photoluminescent components may be used, as described below.

Another constraint is available power. The maximum available power for an LED depends upon its peak wavelength and/or spectral distribution. For some wavelengths in the visible spectrum, the maximum available power is significantly less than for others. More than one LED of a given type may be combined in the SSAL in order to achieve an appropriate balance in power output among the various types used.

Different types of LED technology may be used to realize the various colors or bands within the SSAL. For example, narrow-band devices comprise a semiconductor diode and transmissive optics, and emit light with a spectral distribution characteristic of the diode. The spectral flux emitted by such devices is primarily confined to a relatively narrow band (typically 20-50 nm FWHM) about a single peak wavelength. Peak wavelength varies, depending on the diode material and operating conditions.

Integrated phosphor devices comprise a semiconductor diode and optics which include a quantity of photoluminescent material, which absorbs flux from the diode's emission band, and re-emits that flux over a range of longer wavelengths. The spectral distribution of such devices is relatively broadband (typically over 100 nm FWHM).

Remote phosphor devices comprise a semiconductor diode and transmissive, non-photoluminescent optics, coupled to a separate, photoluminescent optical component. The spectral distribution of such devices is similar to that of the integrated phosphor devices described above. The use of a separate photoluminescent component, however, increases design flexibility. In some embodiments, the SSAL may include special-purpose remote phosphor devices, designed and manufactured specifically for use in the SSAL.

There are optimization criteria that can be used for the SSAL. These include spectral matching, spectral balance, signal to noise optimization, and spectral continuity. For photometric applications, and some other applications, it would be ideal for the SSAL to have a spectral distribution similar to that of the DUT. In some embodiments, the SSAL may be designed as to allow its spectral distribution to be adjusted or "tuned" to approximate the spectral distribution of any given DUT. In other embodiments, the spectral distribution of the SSAL may be fixed, according to some general-purpose criterion, or combination of criteria, such as those listed below.

In further embodiments, the spectral distribution of the SSAL may be tuned to approximate a "flat" spectrum, i.e., a spectrum with equal or approximately equal values at all wavelengths. Such spectral flatness may be defined simply in terms of spectral radiant flux, or in terms of some function thereof, such as spectral flux weighted by the spectral responsivity of a spectroradiometer. The criterion of spectral balance ultimately derives its justification from some form of the signal-to-noise performance criterion, described below.

It is useful to note that for spectroradiometry, spectral balance may be more important than total flux output. The integration time of a spectroradiometer may be increased to compensate for a low optical signal, but due to the possibility of saturating the spectroradiometer array, the integration time is limited by the maximum spectral flux. It follows that an SSAL with a balanced spectrum may deliver better overall signal-to-noise performance (see below) than an SSAL with higher total flux output, and an imbalanced spectrum.

The spectral distribution of the SSAL may be tuned to maximize the signal-to-noise (S:N) performance of a given system during self-absorption measurements, i.e. to minimize the overall spectral variance ($\sigma_\alpha^2(\lambda)$) of self-absorption measurements ($\alpha(\lambda)$), according to one of the following criteria (or some combination of these and other, similar criteria):

i. Total Integrated Noise (TIN):

$$\int_{\lambda_{min}}^{\lambda_{max}} \sigma_\alpha^2(\lambda)d\lambda$$

ii. Total Integrated Photopic Noise (TINV):

$$\int_{\lambda_{min}}^{\lambda_{max}} \sigma_\alpha^2(\lambda)V(\lambda)d\lambda \ \ldots$$

where $V(\lambda)$ represents the spectral luminous efficiency function, the standard engineering representation for the spectral response of the human visual system. Total Integrated Colorimetric Noise (TINXYZ) is similar to TINV, being the sum of three weighted integrals, in which each of three standard CIE color-matching functions is substituted for the $V(\lambda)$ function in the equation above.

If the spectral flux distribution ($\phi(\lambda)$) of the SSAL exhibits a significant gradient ($d\phi/d\lambda$) in a particular region of the measurement spectrum, then any possible shift in the spectroradiometer wavelength scale between auxiliary lamp readings of the reference standard and the DUT may contribute significant uncertainty in the self-absorption factor measurement for that region. For this reason, the spectral continuity, or smoothness, of the SSAL spectrum should be taken into account as part of the overall optimization criterion.

The uncertainty ($\sigma_\phi(\lambda)$) contributed by such gradient effects may be calculated from the applicable repeatability standard deviation ($\sigma_\lambda$) of the spectroradiometer wavelength scale, as follows:

$$\sigma_\phi(\lambda) = \sigma_\lambda \frac{d\phi}{d\lambda}(\lambda)$$

Uncertainty due to such gradient effects can be addressed in at least two different ways. The SSAL spectrum can be designed so as to minimize spectral gradients. Alternatively if the SSAL spectrum does exhibit significant spectral gradients, the spectral absorption factor values measured for the region surrounding the gradient may be rejected, and replaced by values interpolated from smoother regions of the spectrum.

The optical geometry can also be considered. The LEDs in the SSAL are preferably optically coupled to the integrating sphere in such a way that an appropriate geometric distribution of flux within the sphere is achieved. The optimal distribution would depend on the specific DUT; for general purposes, a reasonable specification would be that the SSAL should approximate a Lambertian distribution. A Lambertian distribution can be approximated by means of an optical diffuser placed between the LEDs and the integrating sphere, or by coupling the LEDs to the main sphere via a secondary, "satellite," integrating sphere, or by a combination of these approaches.

FIG. 6 illustrates a spectral distribution for each element of an exemplary 13-element SSAL model designed to cover the full visible range (360-830 nm). The number of elements (13) was selected based on an estimated typical LED bandwidth of 40 nm, and the assumption that terminal elements would be centered near the limits of the spectrum.

FIG. 7 illustrates that such an SSAL could be modulated to approximate an equal-energy spectrum, with more energy than comparable incandescent lamp at short wavelengths, and less at long wavelengths. As noted above, for spectroradiometry, such a balanced spectrum may be preferable to a conventional incandescent spectrum. The output of the SSAL illustrated in FIG. 7 would be comparable to that of a 24 W incandescent lamp. Typical commercially available Auxiliary lamps range from 35 W to 100 W. For spectroradiometric applications, a factor of four decrease in optical signal could readily be compensated by a corresponding increase in integration time. This particular configuration employs a total of 25 LED devices to achieve this result; increasing the number of devices per element would increase total output.

FIG. 8 illustrates the same 13 element SSAL, with elements modulated differently, in order to approximate an incandescent spectrum. As would be apparent to one of ordinary skill in the art after reading this description, other source spectra can also be simulated.

Figure 9:
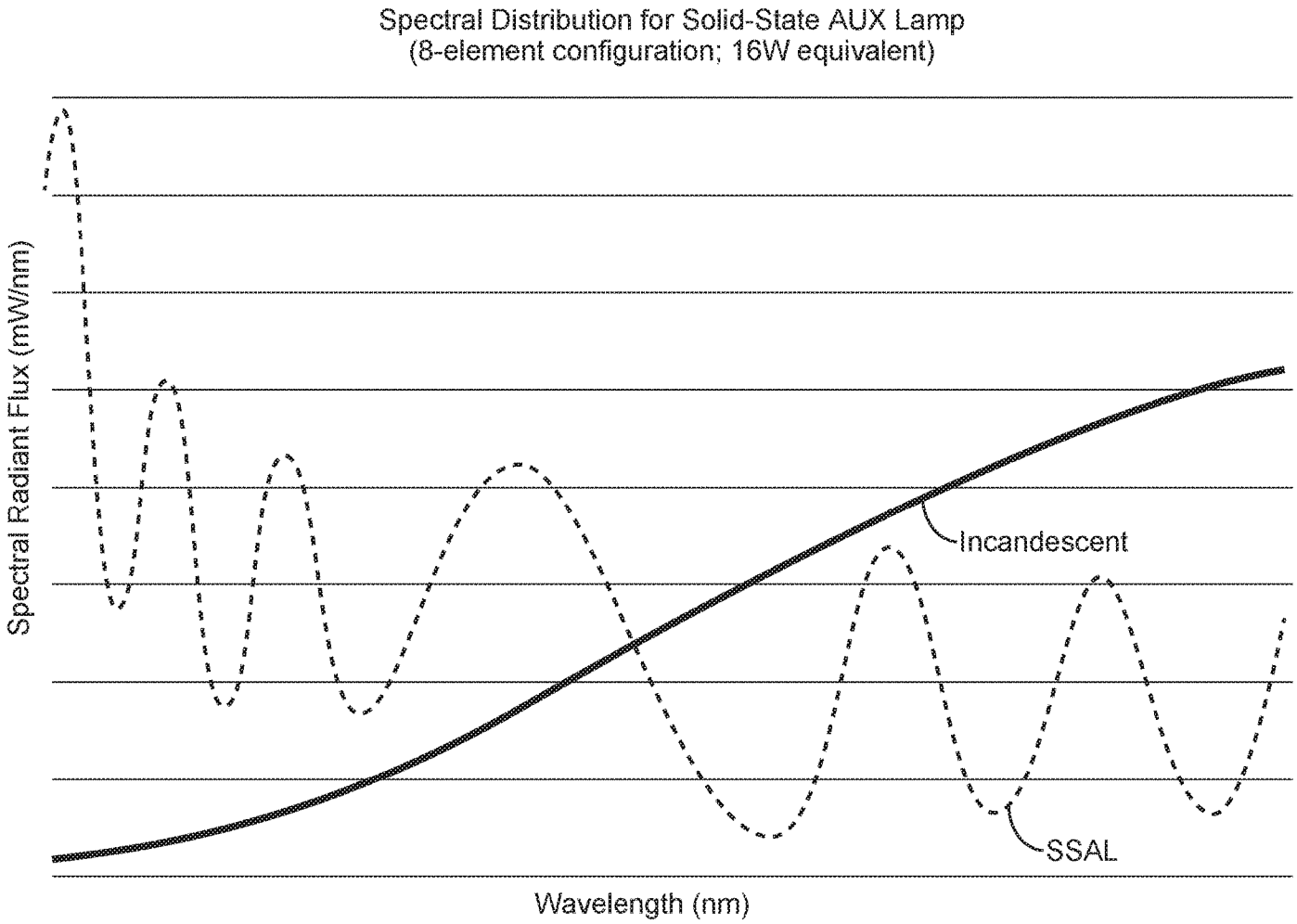
FIG. 9 illustrates the use of eight elements to sufficiently cover the full visible range (360-830 nm), albeit with lower spectral resolution (and greater spectral structure) than the examples presented in FIGS. 7 and 8.

As illustrated in FIG. 9, eight elements may be sufficient to cover the full visible range (360-830 nm), albeit with lower spectral resolution (and greater spectral structure) than the examples presented in FIGS. 7 and 8. In other embodiments, as few as 4 elements may be sufficient to cover the minimal 380-780 nm range. Even more limited spectral coverage may be acceptable for photometric applications. In general, however, increasing the number of different LEDs types used improves the achievable smoothness of the resultant spectra.

The SSAL can support the typical continuous use auxiliary lamp operating scenario. However, as described above, better performance may be achieved when used momentarily or in a non-continuous mode.

Figure 10:
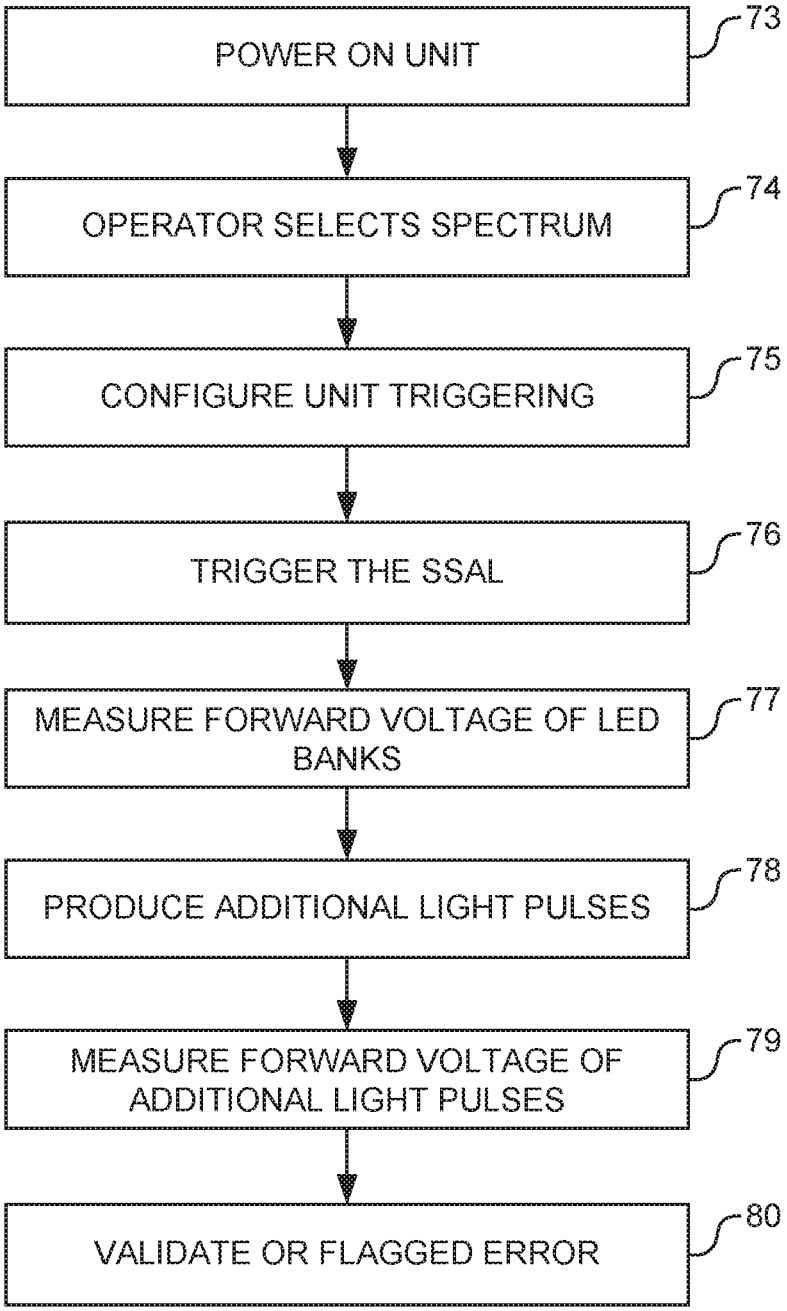
FIG. 10 is a diagram illustrating an example process for operating an SSAL in accordance with one embodiment of the technology described herein.

FIG. 10 is a diagram illustrating an example process for operating an SSAL in accordance with one embodiment of the technology described herein. Referring now to FIG. 10, at operation 73 the unit is powered on. After power on, the SSAL is allowed to warm up, and the lamp head 28 comes to operating temperature. TEC 40 is controlled to maintain lamp head 28 at operating temperature.

At operation 74, an operator chooses a spectrum, output power level, and pulse duration. This can be done either through a front panel or a computer interface (e.g., coupled to the external communication link) or other user interface. At operation 75, the triggering is of the unit is configured. Normally the SSAL is triggered to operate after the spectroradiometer begins integration. In some embodiments, the triggering is implemented using the external trigger I/O port. In other embodiments, the communication/control processor may be used to implement the triggering signal. Then, at operation 76, the SSAL is triggered and the light pulse is produced.

At operation 77, the forward voltage of each LED bank 29*a*, 29*b*, 29*n* is measured during the pulse. These values are recorded and associated with the settings for the particular light pulse. If their temperature has risen above nominal operating temperature, TEC 40 cools the LEDs back down to nominal temperatures. At operation 78, additional light pulses are produced. At operation 79, the LED forward voltage is measured during each light pulse and compared with the saved values; this is used to validate that the light pulse is correct. If they differ an error is declared and can be flagged to the operator via the user interface. This is illustrated at operation 80.

Figure 11:
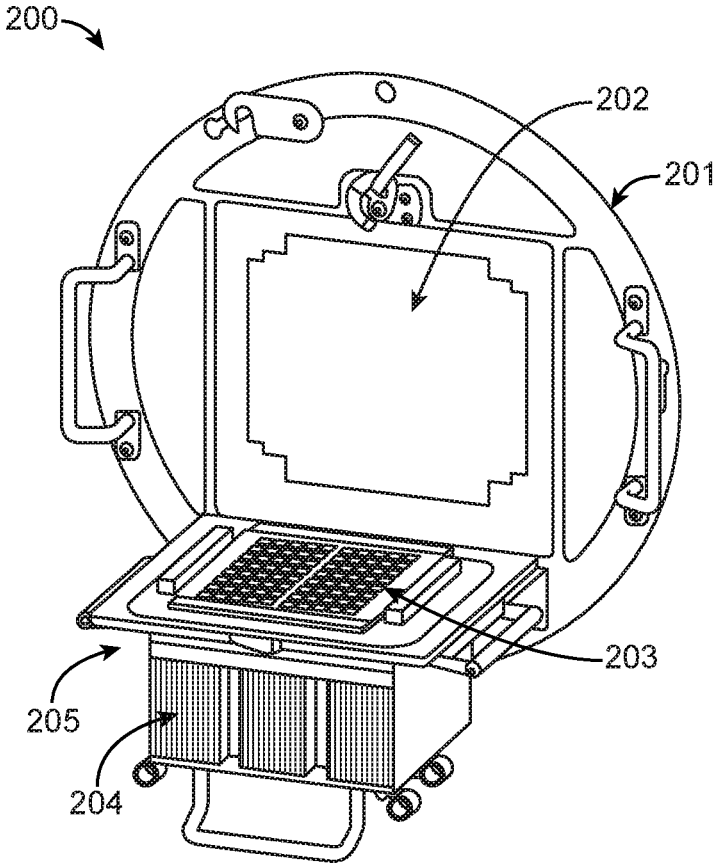
FIG. 11 illustrates an exemplary automatic SSL testing system implemented in accordance with an embodiment of the technology described herein.

FIG. 11 illustrates an exemplary automatic SSL testing system 200 in accordance with an embodiment of the technology described herein. In one embodiment, the hemispheric integrating sphere 201 employs a diffuse white coating for the interior curved surface and a mirror coating on the flat side. In particular embodiments, the diffuser coating provides a Lambertian reflective surface. The flat side mirror creates a perfect reflection of the hemisphere. Further, the flat side allows an entire load board 203 to be mounted in the center of the hemisphere. The drop-down hatch 205 provides an easy operator access, and the load board 203 is situated on the drop-down hatch 205 by a load board mount that is placed in the hatch opening. The drop-down hatch 205 is mounted in the center of a removable section 202 of the flat side. In one embodiment, the overall hemisphere is sized to roughly three times the diameter of the center section 202, which helps to minimize measurement errors. Moreover, the load board's electrical connections are accessed via two push-on connectors on either side of the load board. These connectors may be inserted and removed using manual levers. This manual operation eliminates the need for safety systems and the troublesome spring-loaded "pogo" pins such as those used in other automated systems.

In one embodiment, the automatic SSL testing system 200 has a thermal control platform 204. SSLs including LEDs are temperature sensitive devices. For example, an LED's forward voltage decreases with increasing temperature and an LED's light output can also vary with temperature. It is good practice to measure LEDs at a stable, known temperature. This may be especially important for long-term aging testing of LEDs, where small changes in intensity are closely studied. In one embodiment, the thermal control platform 204 is a high-powered Thermo Electric Cooler (TEC) that is mounted directly below the load board. The TEC is powered with a closed-loop control system that maintains the LED temperature to within 0.01° C. of the correct temperature. The automatic SSL testing system 200 can allow a user to set the correct temperature for different tests.

Still referring to FIG. 11, in one embodiment, a removable plate replaces the load board mount to which the load board 203 is mounted. The removable plate can be placed in the hatch opening. Calibration sources are easily attached to this removable plate and the plate is designed to optically mimic a typical load board. The mimicry reduces the self-absorption correction that must be made. In one embodiment, this removable plate is a paddle plate.

Figure 12:
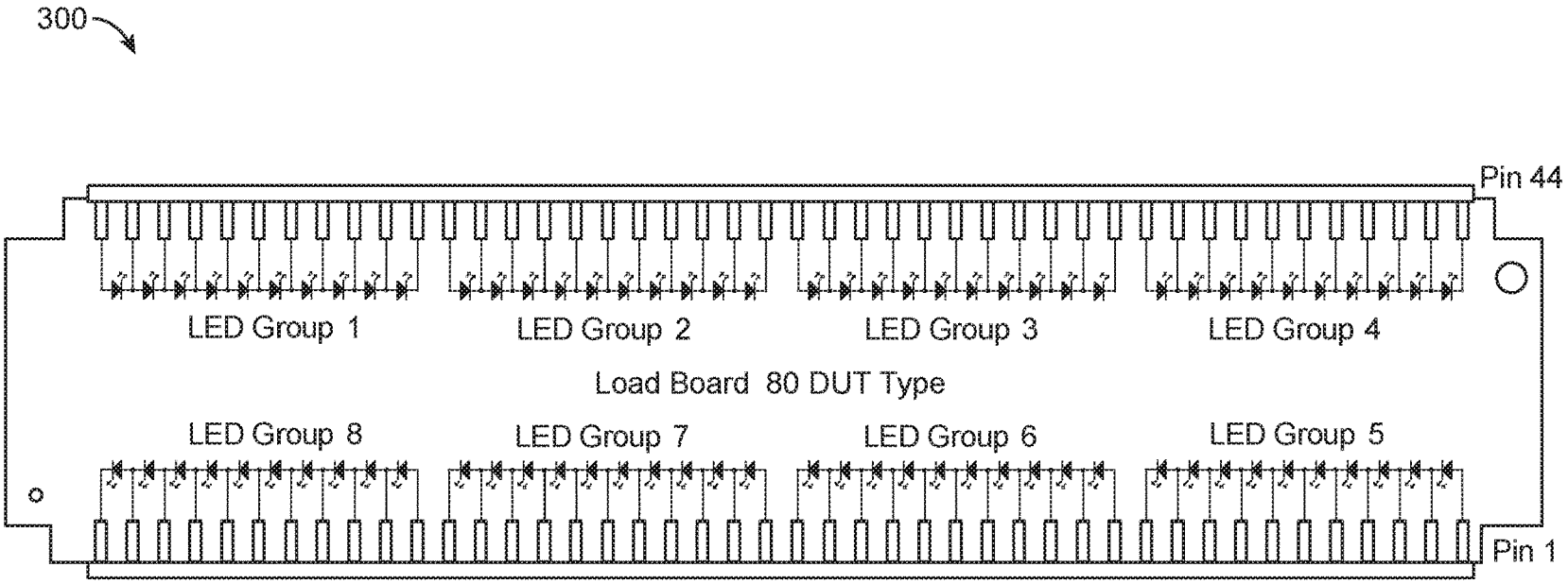
FIG. 12 illustrates an exemplary load board for use with an automatic SSL testing system in accordance with an embodiment of the technology described herein. LEDs are two terminal devices.

FIG. 12 illustrates an exemplary load board 300 for use with an automatic SSL testing system in accordance with an embodiment of the technology described herein. LEDs are two terminal devices. LEDs are generally powered with a constant current, which passes from the LED's anode to cathode. As a result, to independently power a number of LEDs on a load board, typically, the connections needed are twice the number of LEDs. The LED's forward voltage is usually measured using a separate pair of wires, referred to as a 4-wire or kelvin circuit arrangement. Kelvin circuits improve the measurement accuracy but the connections needed are quadruple the number of LEDs. For example, for a load board with eighty (80) LEDs, one hundred and sixty (160) connections are typically needed for powering the LEDs and three hundred and twenty (320) connections are typically needed for voltage measure using Kelvin circuits. A higher capacity load boards will require numerous connections.

In one embodiment, the load board 300 employs the illustrated circuit arrangement that powers groups of LEDs as a series circuit. Within each circuit, individual circuit nodes are wired to connectors located on opposite sides of the load board. As a result of using this arrangement, to individually power and monitor any group of a certain number of LEDs, the number of connections needed is only one more than the number of LEDs. For example, for a load board with eighty (80) LEDs, eighty-one (81) connections are needed for powering and monitoring the LEDs. In one embodiment, as illustrated in FIG. 3, the exemplary load board 300 has the capacity of eighty (80) LEDs. The exemplary load board 300 limits ten (10) LEDs in each LED group; thus, the load board has ten (10) LED groups. Within each group, eleven (11) connections are needed for powering and monitoring 10 LEDs. Accordingly, in the exemplary load board 300, a total of eighty-eight (88) connections are needed for powering and monitoring eighty (80) LEDs.

Figure 13:
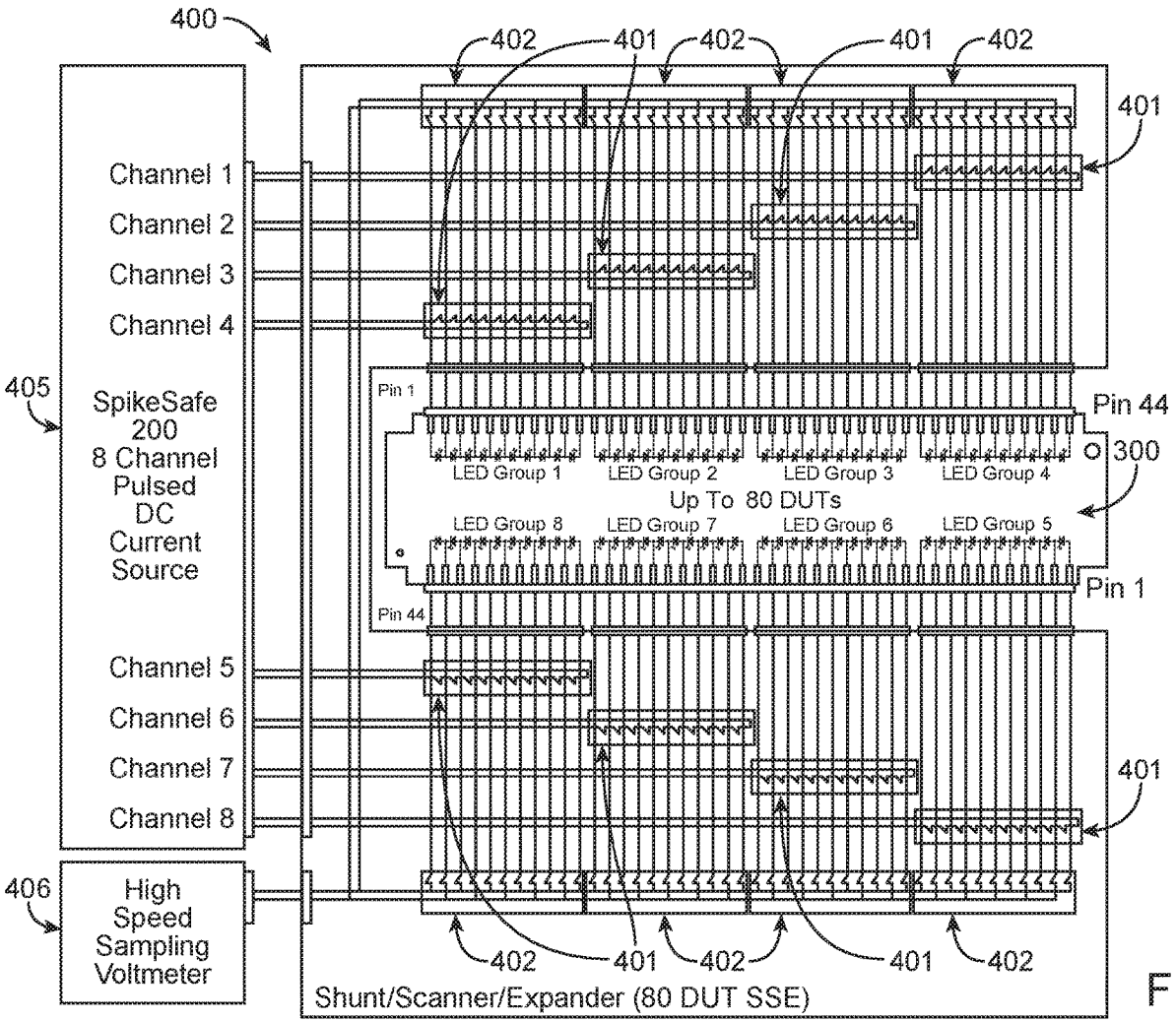
FIG. 13 illustrates an exemplary switch matrix of an automatic SSL testing system in accordance with an embodiment of the invention.

FIG. 13 illustrates an exemplary switch matrix 400 of an automatic SSL testing system in accordance with an embodiment of the invention. In one embodiment, the automatic SSL testing system employs an eight channel current source 405 to drive the eight LED groups on the load board 300. The current source 405 produces high accuracy current pulses that are precisely aligned with a trigger signal that is used to trigger the measurement instrumentation. The use of pulses reduces heating in the LEDs, which in turn results in measurements that are more accurate. The current switch groups 401 steer the drive signals by shunting the current around LEDs that are not tested using the switches in the matrices. The voltage switch groups 402 route the measurement signals to support precision voltage measurements. In one embodiment, the switches in either the current switch groups 401 or the voltage switch groups 402 are high power solid-state switches. In one embodiment, the load board 300 provides eleven contacts, nine of which are wired to switches connected to both the positive and negative output of the current source 405. By activating different switches in the current switch groups 401, individual LEDs or selected groups of LEDs may be powered individually or simultaneously.

Still referring to FIG. 13, to make a forward voltage measurement, the LED anode and cathode connections are routed to a precision voltmeter 406. In one embodiment, only one switch is used per node, which means that half the measurements are presented as positive voltages and the other half as negative voltages at the sampling voltmeter. The automatic SSL testing system or the voltmeter 406 may automatically inverts the polarity of the negative voltages. This polarity inversion may be achieved by a correction module of the automatic SSL testing system. In addition, the automatic SSL testing system also reduces measurement errors due to the wiring resistance. In one embodiment, the automatic SSL testing system uses a Kelvin circuit. Two wires are used to convey power, and two are used to feed the LED's voltage back to the precision voltmeter. Because little current flows on the measurement wires, measurements are not impacted by changes in wiring resistance or in drive current. In one embodiment, the automatic SSL testing system includes resistance correction factors for each LED measurement position. These factors may be determined by measuring a representative load board equipped with shorting jumpers in place of the LEDs. The following method produces the corrected voltage readings.

$$V_{corrected}=V_{raw}-\Omega_{LED\ Position}\times I_{test}$$

where $V_{corrected}$ is the corrected forward voltage reading, $V_{raw}$ is the raw precision voltmeter reading, $\Omega_{LED\ Position}$ is the resistance determined by characterizing a shorted load board, and $I_{test}$ is the current used to drive the LED.

Figure 14:
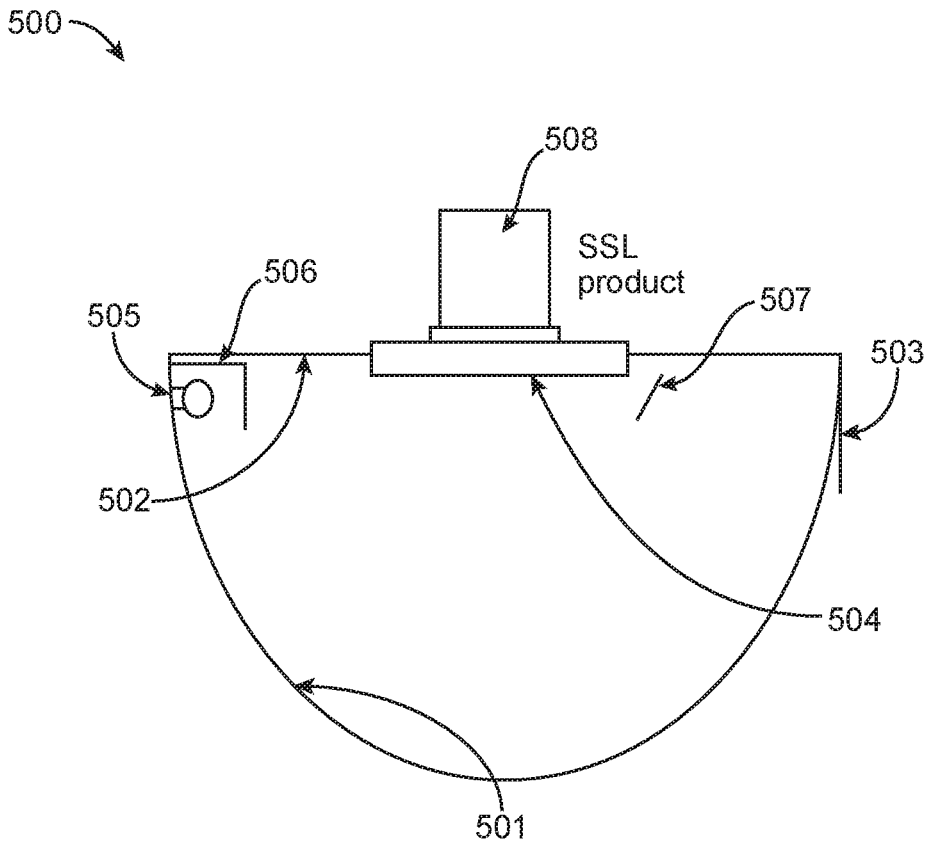
FIG. 14 illustrates a solid state lamp testing system.

FIG. 14 illustrates a solid state lamp testing system. In this example, the system 500 comprises an integrating hemisphere surface 501 having a diffusive white coating. In this embodiment, the system further comprises a flat surface 205 defining the integrating hemisphere with surface 501. In one embodiment, the flat side 502 of the hemispheric integrating sphere uses a mirror coating. The flat side mirror 502 creates a reflection of the hemisphere. The light passing to the detector port 503 is the same as that from a full sphere. In one embodiment, the overall hemisphere is sized to roughly three times the diameter of the center section 504. In one embodiment, smaller spheres are used for low-power devices. In other embodiments, the system 500 comprises a standard spherical lamp testing system, including standard configurations such as 4π and 2π.

The testing system further comprises a receptacle 508 configure to hold a lighting devices, such as reference lamps and devices under test. For example, the receptacle 508 may comprise a hatch-type system as described above with respect to FIG. 11. The system further comprises an auxiliary lamp 505. The auxiliary lamp 505 may comprise an auxiliary lamp of the type described above. Additionally, various baffles 506, 507 prevent light directly shining on port 503 from auxiliary lamp 505 and lights disposed in receptacle 508.

Figure 15:
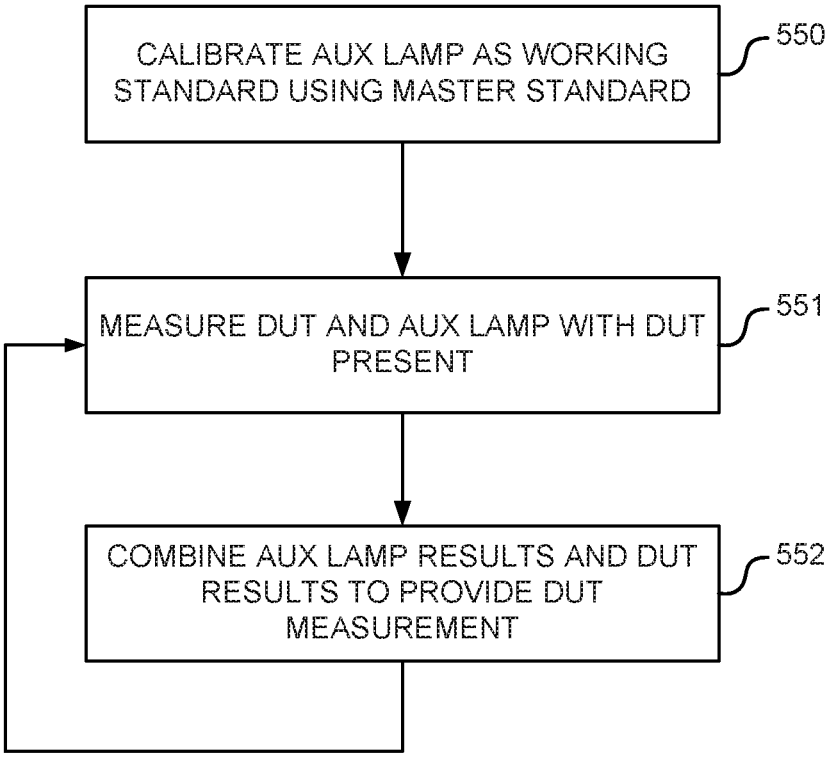
FIG. 15 illustrates a method of measuring DUTs using a SSAL as a working standard.

In an alternative application, a lamp for use as an auxiliary lamp 505 may be treated as a working standard. In other words, it can be configured as a secondary standard lamp (such as standard lamp 505) that remains mounted in the testing system. Such a test system may be hemispherical test systems 501 or spherical test systems. FIG. 15 illustrates a method of using an auxiliary lamp as a working standard.

In this embodiment, the SSAL within the sphere is first calibrated 550 by comparison with a master standard, and thereafter it is used 551 as an intermediate reference standard to measure devices-under-test (DUTs). In this approach, the auxiliary lamp remains within the testing system, so the step of calibrating using the master standard 550 may comprise a single measurement that encompasses both the system calibration and the self absorption can be made.

The measurement equation(s) describing such a procedure are mathematically equivalent to those which describe the conventional application of the auxiliary lamp. Standards document IES LM-79-08, known to those of ordinary skill in the art, describes the conventional use of an auxiliary lamp. It specifies that the DUT self-absorption factor is given by:

$$\alpha(\lambda)=\frac{y_{aux,TEST}(\lambda)}{y_{aux,REF}(\lambda)} \tag{1a}$$

where $y_{aux,TEST}(\lambda)$ is the spectroradiometer reading taken when the DUT is mounted in or on the sphere and illuminated with the auxiliary lamp, and $y_{aux,REF}(\lambda)$ is the spectroradiometer reading taken when the reference total spectral radiant standard is mounted in or on the sphere and illuminated with the auxiliary lamp.

The total spectral radiant flux $\Phi_{TEST}(\lambda)$ of a DUT is obtained by comparison to that of a reference standard $\Phi_{REF}(\lambda)$:

$$\Phi_{TEST}(\lambda)=\Phi_{REF}(\lambda)\cdot\frac{y_{TEST}(\lambda)}{y_{REF}(\lambda)}\cdot\frac{1}{\alpha(\lambda)} \tag{1b}$$

where $y_{TEST}(\lambda)$ and $y_{REF}(\lambda)$ are the spectroradiometer readings for SSL product under test and for reference standard, respectively, and $\alpha(\lambda)$ is the self-absorption factor.

The two equations above can be consolidated into a single, comprehensive measurement equation:

$$\Phi_{TEST}(\lambda)=\Phi_{REF}(\lambda)\cdot\frac{y_{TEST}(\lambda)}{y_{REF}(\lambda)}\cdot\frac{y_{aux,REF}(\lambda)}{y_{aux,TEST}(\lambda)} \tag{1c}$$

Using traditional auxiliary lamps, all the measurements in equation 1c are usually performed within a short timeframe to eliminate errors caused by sphere and aux lamp drift. In other words, both auxiliary lamp readings are typically taken at or near the time of calibration (i.e., reading of the reference lamp). This requires that the system be warmed up before the measurements are taken, which requires time. This also requires that the reference lamp be used for each measurement, which consumes the reference lamp.

Using a stable auxiliary lamp, such as the lamps described herein, the two measurements involving the reference standard may be performed up earlier and less frequently. This has the effect of transferring the reference's calibration to the SSAL 550, making it a working standard. In one embodiment, to use the auxiliary lamp as a working standard, the steps to determine $\Phi_{TEST}$ can be split into two steps 550. The first step 500 is the calibration of the auxiliary lamp as a working standard (WS), by comparison to the master reference standard. In step 550, the master reference lamp is inserted into the test system with the auxiliary lamp mounted in the test system. The reference standard and working standard are then read to obtain:

$$\Phi_{WS}(\lambda) = \Phi_{REF}(\lambda) \cdot \frac{y_{aux,REF}(\lambda)}{y_{REF}(\lambda)} \tag{2a}$$

(Note that here, the self-absorption effect does not play a role, since the test system (e.g., sphere) configuration is not changed between the reading of the reference standard and the working standard.)

In the second step 551, the measurements associated with the DUT are made using the auxiliary lamp as a working standard to obtain:

$$\Phi_{DUT}(\lambda) = \frac{y_{TEST}(\lambda)}{y_{aux,TEST}(\lambda)} \tag{2b}$$

Finally these two results are combined to obtain the DUT measurement.

$$\Phi_{TEST}(\lambda)=\Phi_{WS}(\lambda)\cdot\Phi_{DUT}(\lambda) \tag{2c}$$

Substituting equations (2a) and (2c) demonstrates that equation (2c) is equivalent, and hence, provides the same measurements as equation (1c).

In some embodiments, step 550 does not need to be performed each time steps 551 and 552 are performed. The reference measurement $y_{aux,REF}(\lambda)$ is taken at the time of calibration 550 with the master standard (REF), while $y_{aux,TEST}(\lambda)$ is taken at the time of DUT measurement 551. While step 550 may be performed whenever recalibration of the auxiliary lamp is desired, multiple DUT measurements may be made between calibrations. For example, In some applications, the reference measurement 550 can be made once in a given period (e.g., weekly) and the SSAL working standard used for all DUT measurements in that period. This can reduce the time otherwise required to warm up the reference standard for testing, and it can reduce the usage (and drain) of the reference standard.

Additionally, step 550 may be performed at much earlier times than steps 551 and 552. For example, the auxiliary lamp calibration may be performed, days, weeks, or months before steps 551 and 552.

Another benefit that can be attained by using the SSAL as the working standard is that by separating the auxiliary lamp readings, with one taken at the time of calibration, and the other taken at the time of DUT measurement, the ratio of these readings can serve to compensate, not only for the opto-mechanical change between calibration and test configurations (as in the conventional method) but also for any drift or fluctuation in system responsivity due to changes in average sphere wall reflectance, ambient temperature, or other factors.

In principle, the working standard approach should be possible with a conventional auxiliary lamp as well as with a solid-state auxiliary lamp. In practice, however, the SSAL is more feasible as a candidate for the working standard. The working standard approach methodology is designed to reduce or eliminate measurement uncertainty due to drift or fluctuation in system responsivity between calibration and measurement. The temporal separation of auxiliary lamp readings, however, also introduces some additional uncertainty, associated with potential drift or fluctuation in the output of the auxiliary lamp itself.

Due to the long warmup time and frequent use of the auxiliary lamp, typical aging of an incandescent lamp, used as both an auxiliary lamp and a working standard, could contribute significant measurement uncertainty over relatively short periods. This could require recalibration by the master standard at impractically short intervals, or else negate the advantage of the working standard approach method. Conversely, the short warmup time and superior stability of the SSAL would allow for more frequent use of the working standard, with less frequent use of the master standard, thereby extending the life of the master standard, and reducing overall measurement uncertainty.

Another application of the technology disclosed herein is the use of a solid-state lamp system as a master standard, in place of the conventional incandescent lamp. A lamp system similar to the SSAL described above, but designed specifically for use as a master standard, may be described as a Solid-State Reference Lamp (SSRL).

A master standard lamp is an artifact that is used to transfer a calibration from an authoritative reference metrology laboratory to the local laboratory in which specific testing is to be performed. Such an artifact, in combination with related calibration data, and appropriate documentation of calibration conditions, uncertainty analysis, etc., provides traceability of measurements performed in the local laboratory to the reference laboratory. A master standard lamp may be used in the local laboratory to calibrate, directly or indirectly, an integrating-sphere spectroradiometer system, following either the conventional method described in equations (1a)-(1b), or the alternative method described in equations (2a)-(2b).

The requirements for a master standard (REF) lamp include all of the requirements outlined for a conventional auxiliary lamp above. More specific requirements for a master standard lamp may include stability. The lamp must provide a repeatable output over an extended period of time, from its calibration at the reference laboratory to initial use at the local lab, and under repeated use at the laboratory. The useful life of the lamp may be measured in either calendar time, or in service hours. With appropriate handling and storage, the lamp should remain stable over a period of months or years, and over a service life on the order of 100 uses. The criterion typically used to determine the useful life of a conventional incandescent lamp standard is that the relative change in the luminous flux output of the lamp, under specified conditions, should be ≤0.5%.

A solid-state reference lamp system (SSRL), similar to the SSAL described above, could be used as the reference standard (REF) in either the conventional method described in equations (1a)-(1b), or the alternative (WSA) method described in equations (2a)-(2b).

The SSRL need not be permanently installed in the integrating sphere, but would typically be inserted in the sphere in place of the DUT at the time of calibration only. When not in use, the SSRL may be stored under controlled conditions to maximize its useful life. To facilitate calibration at the reference laboratory, the SSRL may be configured in a manner compatible with industry-standard mounting fixtures.

The drawbacks of a conventional incandescent standard lamp are similar to those for an auxiliary lamp as outlined above. The benefits of an SSRL, are similar to those outlined for SSAL. Considerations more specific to a master standard lamp may be outlined as follows. The reduced warm-up time required for the SSRL means that a greater fraction of the lamp's useful service life is available to provide system calibration. The time required for calibration is also reduced, though this is less critical for a master standard than for an auxiliary lamp or working standard, due to less frequent use. If designed to provide a tunable output spectrum, the SSRL may be calibrated in more than one spectral configuration, in order to more closely approximate the spectra of various DUTs, or otherwise to provide optimal reference spectra for various applications.

An auxiliary lamp (SSAL) may also be used as a master standard, periodically submitted to a reference laboratory for calibration, but otherwise permanently installed in the sphere system. This embodiment can be represented by the following equation:

$$\Phi_{TEST}(\lambda) = \Phi_{REF}(\lambda) \cdot \frac{y_{TEST}(\lambda)}{y_{REF}(\lambda)} \tag{3}$$

In such embodiments, the SSAL itself serves as the master (REF) standard, with no intermediate working standard. The substitution effect would play no role, and so the SSAL would simply be treated as the REF lamp, with no need for auxiliary lamp readings, per se. Such an approach would place a greater demand on SSAL performance. Particularly, stability would be required over long periods, as for the SSRL, and, due to more frequent use of the SSAL, the required service life would be much longer than that required even for the SSRL. Also, in such an application, the master standard lamp would be subjected to greater risk of contamination, and other potential causes of degradation, due to its prolonged exposure in the lab environment.

In further embodiments, an SSAL may be used with a system and method for automatic measurement of solid state lighting (SSL) including LED photometric. Use of an automatic measurement system reduces the number of connections necessary to power the SSLs including LEDs, gathers 100% of the light, eliminates the need for robotic control, maintains the SSLs including LEDs at a precise temperature, reduces electrical measurement errors due to contact and wire resistance, and eliminates measurement errors caused by physical asymmetries in the test board and hemisphere. The automatic measurement system can make rapid and accurate measurements of SSLs including LEDs. The automatic measurement system may work well for both low power LEDs and high powered LED modules. In one embodiment, measurement uncertainty is below 2.5% at a 95% confidence interval.

Figure 16:
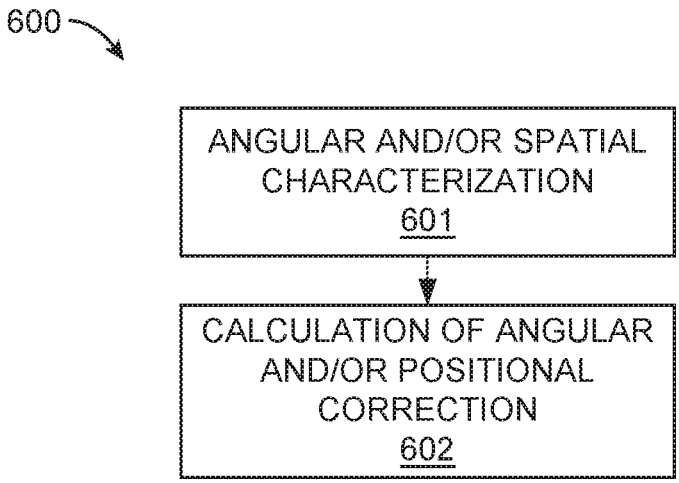
FIG. 16 illustrates a method of characterization and connection for spatial non-uniformity of response in an integrating sphere or hemisphere photometer in accordance with an embodiment of the invention.

FIG. 16 illustrates a method of characterization and connection for spatial non-uniformity of response in an integrating sphere or hemisphere photometer in accordance with an embodiment of the invention. The method corrects measurements based upon the position of the SSL with respect to the center of the mirror. The corrections account for both the (x,y) translation of the SSL, as well as the SSL angular radiation pattern. Spatial non-uniformity includes angular non-uniformity and positional non-uniformity. Angular non-uniformity is variation in the response of the instrument to radiation from the device under test (DUT) as a function of the direction of radiation, quantifiable in terms of zenith and azimuth angle. Positional non-uniformity is variation in the response of the instrument to radiation from the DUT as a function of position within the integrating cavity, quantifiable in terms of linear displacement (x,y) from a reference position.

Spatial characterization is variation in an instrument's response to a constant optical signal, as a function of both angle and direction of radiation from the device, where device position (x,y) is characterized by test and/or analysis. The results of spatial characterization are combined with the known angular distribution of the DUT and reference standard source to calculate the relative responsivity of the instrument to each of these sources. The ratio of these responsivities indicates the measurement bias due to spatial non-uniformities. This bias is corrected by dividing the direct measurement result obtained for the DUT by the correction factor.

At step 601, in one embodiment, the method characterizes an variation of an instrument's response to a constant optical signal generated from a goniometric source or a stable and representative device under test (DUT) as a function of one or more angular directions and/or one or more positional directions. This instrument may be a spectroradiometer, designed to measure the spectral power distributions of illuminants. In one embodiment, for angular characterization, a goniometric source, or "scanning beam," substituted for the DUT, is used. This goniometric source provides a directional beam of radiation, and can be re-oriented over a range of angles. The goniometric source spans the range of directions of radiation from any DUT of interest. The optical output of the source is kept constant, and the variation in the instrument's response to this constant optical signal, as a function of direction ($\vartheta$,$\phi$), is recorded. This function may be denoted as $K(\vartheta, \phi)$.

$$K(\theta, \phi) = \frac{\int_{\phi=0}^{2\pi}\int_{\theta=0}^{\theta_{max}} I_{DUT}(\theta, \phi)K(\theta, \phi)\sin\theta d\theta d\phi}{\int_{\phi=0}^{2\pi}\int_{\theta=0}^{\theta_{max}} I_{REF}(\theta, \phi)K(\theta, \phi)\sin\theta d\theta d\phi}$$

In one embodiment, the angular characterization described above is repeated with the goniometric source centered at various positions, spanning the specified range of DUT positions. The combined angular and positional function may be denoted as $M(x,y,\vartheta,\phi)$.

In one embodiment, for a stable, representative device under test (rDUT), matching the dimensions and angular distribution of a specified type of DUT, the rDUT output is measured in various positions, spanning the specified range of DUT positions. The operating conditions of the rDUT, e.g., drive current, pulse width, temperature, are kept constant, in order to keep the optical output constant. The variation in the instrument's response to this constant optical signal, as a function of position (x,y) is recorded. This function may be denoted as P(x,y).

$$P(x, y) = \frac{\int_{\phi=0}^{2\pi}\int_{\theta=0}^{\theta_{max}} I_{DUT}(\theta, \phi)M(x, y, \theta, \phi)\sin\theta d\theta d\phi}{\int_{\phi=0}^{2\pi}\int_{\theta=0}^{\theta_{max}} I_{REF}(\theta, \phi)M(x, y, \theta, \phi)\sin\theta d\theta d\phi}$$

At step 602, in one embodiment, the method generates an angular correction factor and a plurality of positional correction factors by using the function from step 601 to compare between a first plurality of measurements of a DUT with a specified angular distribution and a second plurality of measurements of an ideal point source, the DUT and the ideal point source having the same total flux. In one embodiment, for angular correction, the relative instrument response as a function of direction, K(ϑ, ϕ), is used to calculate the bias between measurements of a DUT with a specified angular distribution, I(ϑ, ϕ), representing luminous or radiant intensity as a function of angle, and an ideal point source with the same total flux. In one embodiment, I(ϑ, ϕ) is normalized such that integration over the full range of directions considered yields a value of one. The instrument's response to the DUT, and the instrument's response to an ideal point source with equivalent flux, are calculated by simulation. The ratio of these two values is the angular correction factor, $a_{DUT}$.

$$a_{DUT} = \frac{\int_{\phi=0}^{2\pi}\int_{\theta=0}^{\vartheta_{max}} I_{DUT}(\theta, \phi)M(\theta, \phi)\sin\theta d\theta d\phi}{\int_{\phi=0}^{2\pi}\int_{\theta=0}^{\vartheta_{max}} K(\theta, \phi)\sin\theta d\theta d\phi}$$

A similar calculation is performed using the angular distribution for the reference standard lamp (REF) used to calibrate the sphere, to obtain the correction factor $a_{REF}$.

$$a_{REF} = \frac{\int_{\phi=0}^{2\pi}\int_{\theta=0}^{\vartheta_{max}} I_{REF}(\theta, \phi)K(\theta, \phi)\sin\theta d\theta d\phi}{\int_{\phi=0}^{2\pi}\int_{\theta=0}^{\vartheta_{max}} K(\theta, \phi)\sin\theta d\theta d\phi}$$

The ratio of these two factors yields the final angular correction factor, a*.

$$a^* = \frac{a_{DUT}}{a_{REF}}$$

The deviation of this ratio from one (1) represents the relative bias due to angular non-uniformities. Such bias may be corrected by dividing the direct measurement result obtained for the DUT by the correction factor a*.

In one embodiment, The angular correction factor described above is calculated for each of the characterization positions (x,y), using the function M(x,y,q,f), in place of K(ϑ, ϕ).

$$P(x, y) = \frac{\int_{\phi=0}^{2\pi}\int_{\theta=0}^{\vartheta_{max}} I_{DUT}(\theta, \phi)M(x, y, \theta, \phi)\sin\theta d\theta d\phi}{\int_{\phi=0}^{2\pi}\int_{\theta=0}^{\vartheta_{max}} I_{REF}(\theta, \phi)M(x, y, \theta, \phi)\sin\theta d\theta d\phi}$$

The angular correction factor calculated for the reference position (0,0) is adopted as a*. The correction factors calculated for each of the other positions are divided by this value to obtain an array of positional correction factor values p(x,y).

$$p(x,y)=P(x,y)/P(0,0)$$

In one embodiment, The relative instrument response as a function of position, P(x,y), observed for a specific type of DUT, is used to calculate positional correction factor values p(x,y) according to the following:

$$p(x,y)=P(x,y)/P(0,0)$$

In one embodiment, for each characterization position, the combined spatial correction function is simply the product of the angular and positional correction factors according to the following:

$$s^*(x,y)=p(x,y)\cdot a^*$$

This spatial correction function may be interpolated over (x,y) as needed to obtain an estimate of the appropriate spatial correction factor for any position within the range of characterization. The deviation of s*(x,y) from one (1) represents the relative bias in measurements of the DUT in a given position due to the combination of angular and positional non-uniformities. Such bias may be corrected by dividing the direct measurement result obtained for the DUT in position (x,y) by the corresponding correction factor s*(x,y).

In one embodiment, this method may readily be extended to characterize and correct for spatial non-uniformities as a function of wavelength.

The method 600 can be applied to forward-flux measurements, as well as total flux measurements, based on selection of $\vartheta_{max}$, where $\vartheta_{max}$ is 2πfor total flux and π for forward flux. Other regional flux measurements may be also be calculated for different ranges of ϑ. For example, surface-mount DUTs, diffuse and directional LEDs, directional reference lamp, tangentially-mounted and centrally-mounted DUTs can all be measured by the method 600. The method applies to an integrating hemisphere, smaller spheres, and other integrating cavities.

LEDs are used to illustrate various embodiments of this technology; however, the system and the method can also be used to test other SSL devices, for example, organic lighting-emitting diodes (OLEDs) and polymer lighting-emitting diodes (PLEDs).

While various embodiments of the disclosed technology have been described above, it should be understood that they have been presented by way of example only, and not of limitation. Likewise, the various diagrams may depict an example architectural or other configuration for the disclosed technology, which is done to aid in understanding the features and functionality that can be included in the disclosed technology. The disclosed technology is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the technology disclosed herein. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Figure 17:
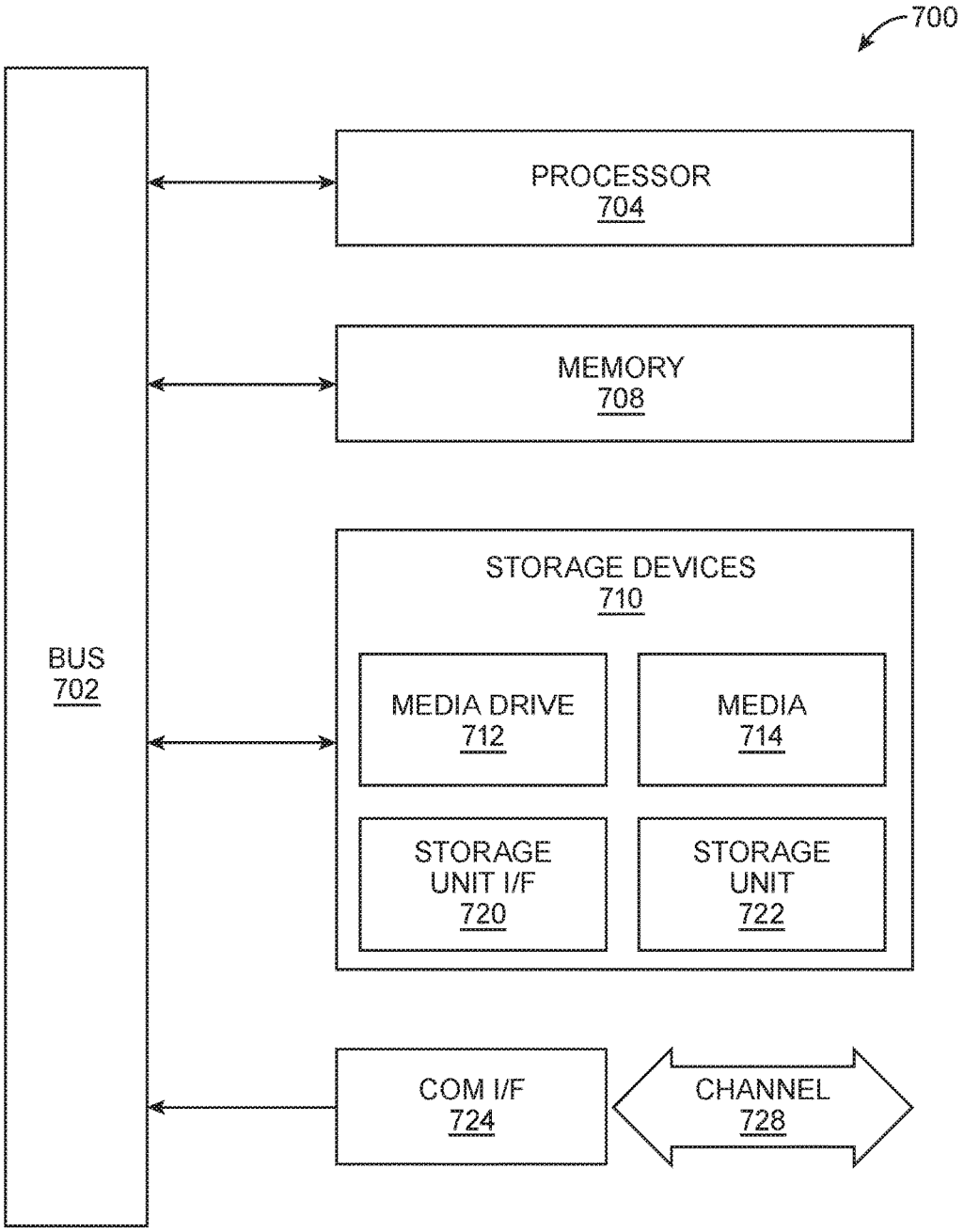
FIG. 17 illustrates an example computing module that may be used in implementing various features of embodiments of the disclosed technology.

As used herein, the term system might describe a given unit of functionality that can be performed in accordance with one or more embodiments of the present invention. As used herein, a module might be implemented utilizing any form of hardware, software, or a combination thereof. For example, one or more processors, controllers, ASICs, PLAs, PALs, CPLDs, FPGAs, logical components, software routines or other mechanisms might be implemented to make up a module. In implementation, the various modules described herein might be implemented as discrete modules or the functions and features described can be shared in part or in total among one or more modules. In other words, as would be apparent to one of ordinary skill in the art after reading this description, the various features and functionality described herein may be implemented in any given application and can be implemented in one or more separate or shared modules in various combinations and permutations. Even though various features or elements of functionality may be individually described or claimed as separate modules, one of ordinary skill in the art will understand that these features and functionality can be shared among one or more common software and hardware elements, and such description shall not require or imply that separate hardware or software components are used to implement such features or functionality.

Where components or modules of the invention are implemented in whole or in part using software, in one embodiment, these software elements can be implemented to operate with a computing or processing module capable of carrying out the functionality described with respect thereto. One such example computing module is shown in FIG. 17. Various embodiments are described in terms of this example-computing module 700. After reading this description, it will become apparent to a person skilled in the relevant art how to implement the invention using other computing modules or architectures.

Referring now to FIG. 17, computing module 700 may represent, for example, computing or processing capabilities found within desktop, laptop and notebook computers; hand-held computing devices (PDA's, smart phones, cell phones, palmtops, etc.); mainframes, supercomputers, workstations or servers; or any other type of special-purpose or general-purpose computing devices as may be desirable or appropriate for a given application or environment. Computing module 700 might also represent computing capabilities embedded within or otherwise available to a given device. For example, a computing module might be found in other electronic devices such as, for example, digital cameras, navigation systems, cellular telephones, portable computing devices, modems, routers, WAPs, terminals and other electronic devices that might include some form of processing capability.

Computing module 700 might include, for example, one or more processors, controllers, control modules, or other processing devices, such as a processor 704. Processor 704 might be implemented using a general-purpose or special-purpose processing engine such as, for example, a microprocessor, controller, or other control logic. In the illustrated example, processor 704 is connected to a bus 702, although any communication medium can be used to facilitate interaction with other components of computing module 700 or to communicate externally.

Computing module 700 might also include one or more memory modules, simply referred to herein as main memory 708. For example, preferably random access memory (RAM) or other dynamic memory, might be used for storing information and instructions to be executed by processor 704. Main memory 708 might also be used for storing temporary variables or other intermediate information during execution of instructions to be executed by processor 704. Computing module 700 might likewise include a read only memory ("ROM") or other static storage device coupled to bus 702 for storing static information and instructions for processor 704.

The computing module 700 might also include one or more various forms of information storage mechanism 710, which might include, for example, a media drive 712 and a storage unit interface 720. The media drive 712 might include a drive or other mechanism to support fixed or removable storage media 714. For example, a hard disk drive, a floppy disk drive, a magnetic tape drive, an optical disk drive, a CD or DVD drive (R or RW), or other removable or fixed media drive might be provided. Accordingly, storage media 714 might include, for example, a hard disk, a floppy disk, magnetic tape, cartridge, optical disk, a CD or DVD, or other fixed or removable medium that is read by, written to or accessed by media drive 712. As these examples illustrate, the storage media 714 can include a computer usable storage medium having stored therein computer software or data.

In alternative embodiments, information storage mechanism 710 might include other similar instrumentalities for allowing computer programs or other instructions or data to be loaded into computing module 700. Such instrumentalities might include, for example, a fixed or removable storage unit 722 and an interface 720. Examples of such storage units 722 and interfaces 720 can include a program cartridge and cartridge interface, a removable memory (for example, a flash memory or other removable memory module) and memory slot, a PCMCIA slot and card, and other fixed or removable storage units 722 and interfaces 720 that allow software and data to be transferred from the storage unit 722 to computing module 700.

Computing module 700 might also include a communications interface 724. Communications interface 724 might be used to allow software and data to be transferred between computing module 700 and external devices. Examples of communications interface 724 might include a modem or softmodem, a network interface (such as an Ethernet, network interface card, WiMedia, IEEE 802.XX or other interface), a communications port (such as for example, a USB port, IR port, RS232 port Bluetooth® interface, or other port), or other communications interface. Software and data transferred via communications interface 724 might typically be carried on signals, which can be electronic, electromagnetic (which includes optical) or other signals capable of being exchanged by a given communications interface 724. These signals might be provided to communications interface 724 via a channel 728. This channel 728 might carry signals and might be implemented using a wired or wireless communication medium. Some examples of a channel might include a phone line, a cellular link, an RF link, an optical link, a network interface, a local or wide area network, and other wired or wireless communications channels.

In this document, the terms "computer program medium" and "computer usable medium" are used to generally refer to media such as, for example, memory 708, storage unit 720, media 714, and channel 728. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the computing module 700 to perform features or functions of the present invention as discussed herein.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the disclosed technology is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the disclosed technology, whether or not such embodiments are described and whether or not such features are presented as being a part of a described embodiment. Thus, the breadth and scope of the technology disclosed herein should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

The invention claimed is:

1. A method, comprising:

mounting a lamp head of a solid-state auxiliary lamp in an integrating cavity of a solid state lamp testing system, wherein the solid-state auxiliary lamp comprises:

a lamp head comprising a plurality of LED modules; and a drive unit comprising:

a plurality of current sources, each of the current sources coupled to a corresponding LED module; and a processor coupled to the current sources and configured to control each current source to control the light output of each current source's corresponding LED module.

2. The method of claim 1, wherein the solid-state auxiliary lamp further comprises: a thermoelectric cooler coupled to the plurality of LED modules.

3. The method of claim 2, wherein the processor is coupled to the thermoelectric cooler and configured to regulate the temperature of the plurality of LED modules.

4. The method of claim 1, wherein each of the plurality of LED modules has a different peak wavelength or spectral distribution.

5. The method of claim 1, wherein the plurality of the LED modules comprises groups of LEDs, each group having a different peak wavelength or spectral distribution from the other groups.

6. The method of claim 1, wherein each of the plurality of LED modules comprises a set of one or more LEDs, and wherein each LED in a set of one or more LEDs has the substantially the same peak wavelength or spectral distribution as the other LEDs in that set.

7. The method of claim 1, further comprising: driving each of the plurality of LED modules by a series of pulses, the pulses having periods that are sufficiently smaller than a time constant of a measurement instrument in the solid state lamp testing system such that the measurement instrument measures the output of the LED modules as a constant output.

8. The method of claim 1, further comprising: driving each of the plurality of LED modules by an individual pulse at a constant set current.

9. The method of claim 1, further comprising: driving each of the plurality of LED modules by a burst of pulses at a constant set current, wherein the length of the burst of pulses is smaller than an integration time of a measurement instrument in the solid state lamp testing system and the pulses have periods that are sufficiently smaller than a time constant of a measurement instrument in the solid state lamp testing system such that the measurement instrument measures the output of the LED modules as a constant output.

10. The method of claim 1, further comprising: driving each of the plurality of LED modules concurrently.

11. The method of claim 1, further comprising: sequentially pulsing each of the plurality of LED modules such that the sequence of pulses has a shorter duration than an integration time of a measurement instrument in solid state lamp testing system.

12. The method of claim 1, further comprising: calibrating the solid state auxiliary lamp as a working standard in the integrating cavity by comparison with a master reference standard.

13. The method of claim 12, wherein calibrating the solid state auxiliary lamp comprises: inserting a master reference lamp into the solid state lamp testing system with the solid state auxiliary lamp mounted in the solid state lamp testing system; and reading the working standard and the master reference standard.

14. The method of claim 12, wherein the method further comprises: after calibrating the solid state auxiliary lamp as the working standard, using the solid state auxiliary lamp as the working standard to measure a device-under-test.

15. The method of claim 1, wherein the integrating cavity is an integrating sphere or hemisphere.

16. The method of claim 1, further comprising:

mounting a device under test in the solid state lamp testing system; and measuring the device under test with the solid state auxiliary lamp present.

17. The method of claim 1, further comprising:

powering on the solid state auxiliary lamp; and triggering the solid state auxiliary lamp to produce a light pulse.

18. The method of claim 17, further comprising:

measuring a first forward voltage of each of the plurality of LED modules during the light pulse;

recording the measured first forward voltage of each of the plurality of LED modules;

triggering the solid state auxiliary lamp to produce a second light pulse; and measuring a second forward voltage of each of the plurality of LED modules during the second light pulse.

19. The method of claim 18, further comprising: comparing the measured second forward voltage of each of the plurality of LED modules with the recorded first forward voltage of each of the plurality of LED modules to validate that the second light pulse is correct.

20. The method of claim 19, further comprising:

choosing a spectrum and pulse duration of the solid state auxiliary lamp; and configuring triggering of the solid state auxiliary lamp.

* * * * *